US011003113B2

(12) United States Patent
Saito

(10) Patent No.: US 11,003,113 B2
(45) Date of Patent: May 11, 2021

(54) PRESSING DEVICE AND FIXING DEVICE

(71) Applicant: CANON KABUSHIKI KAISHA, Tokyo (JP)

(72) Inventor: Shutaro Saito, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/855,225

(22) Filed: Apr. 22, 2020

(65) Prior Publication Data

US 2020/0341415 A1 Oct. 29, 2020

(30) Foreign Application Priority Data

Apr. 26, 2019 (JP) ..... JP2019-085385

(51) Int. Cl.
*G03G 15/20* (2006.01)
*G03G 15/16* (2006.01)

(52) U.S. Cl.
CPC ..... *G03G 15/2035* (2013.01); *G03G 15/1665* (2013.01); *G03G 2215/0054* (2013.01)

(58) Field of Classification Search
CPC ..... G03G 15/2032; G03G 15/2035
USPC ..... 399/122, 328, 329
See application file for complete search history.

(56) References Cited

U.S. PATENT DOCUMENTS 8,630,556 B2 * 1/2014 Yamada ..... G03G 15/2032 399/122
10,591,853 B2 * 3/2020 Tomita et al. ..... G03G 15/2032

FOREIGN PATENT DOCUMENTS

JP 2018-173623 A 11/2018

* cited by examiner

*Primary Examiner* — William J Royer
(74) *Attorney, Agent, or Firm* — Venable LLP

(57) ABSTRACT

A pressing device includes a cam member 120, a bearing 120*a*, a cam portion 120*b*, a cam engaging portion 120*c* of snap fit fashion. The bearing 102*a* is rotatably supported by a fixation frame 115. The cam portion 120*b* is provided on one side of the bearing 120*a* and contacts a pressing lever. The cam engaging portion 120*c* is provided on the other side of the bearing 120*a* and engages with a hole 123*a* formed on an outer surface of a cam shaft 123. The cam engaging portion 120*c* engages with the hole 123*a* at a position away from a maximum load portion of the cam portion 120*b* by not less than 90 degrees phase different.

18 Claims, 17 Drawing Sheets

PRESSING DEVICE AND FIXING DEVICE

FIELD OF THE INVENTION AND RELATED ART

The present invention relates to a pressure applying device equipped with a rotational member which contacts a pressing member, and a fixing device for fixing a toner image to a sheet of recording medium.

There are image forming apparatuses equipped with a fixing device which fixes a toner image to a sheet of recording medium by which the toner image is borne, by pressing and heating the sheet of recording medium, and the toner image thereon. Generally speaking, this type of fixing device is provided with a pair of rotatable members which form a nip through which a sheet of recording medium is conveyed. It fixes a toner image to a sheet of recording medium by heating and pressing the sheet and the toner image thereon while it conveys the sheet through the nip. This type of fixing device is provided with a pressure applying mechanism for pressuring one of the rotational members upon the other.

For example, an example of this type of fixing device is disclosed in Japanese Laid-open Patent Application No. 2018-173623. This fixing device is provided with a pair of pressure levers for pressuring one of the rotational members toward the other, a rotational shaft, and a pair of cams fitted around the rotational shaft. It is structured so that the pressure levers are moved by rotating the cams, in order to change the fixing device in the amount of pressure applied by the pressure levers. In the case of this fixing device, each of the lengthwise end portions of the rotational shaft is supported by a corresponding side wall of the fixing device, with a part of the cam sandwiched between the rotational shaft and the side wall. Further, the cam is provided with an elastic projection. It is fixed to the rotational shaft by the fitting of the elastic projection into a cam retention hole with which the rotational shaft is provided.

In the case of a fixing device structured so that a cam is rotated to move a pressure lever as disclosed in Japanese Laid-open Patent Application No. 2018-173623, as the pressure lever is moved, the cam is subjected to a load from the pressure lever. That is, the cam is subjected to such force that acts to cause the cam to pivotally deform about the point of the cam, at which the cam is supported by the side wall, by the load which acts on the point of contact between the cam and a pressure roller.

Further, in the case of a fixing device structured as disclosed in Japanese Laid-open Patent Application No. 2018-173623, the cam is fixed to a rotational shaft by the fitting of the aforementioned projection (second engaging portion), with which the cam is provided, into the cam retention hole (first engaging portion) of the rotational shaft, by the bending of the portion of the cam having the projection. Therefore, it sometimes occurs that this load works in the direction to cause the projection to come out of the cam retention hole of the rotational shaft as described above, although it depends on the relationship between the direction in which the portion of the cam, which has the projection will be bent, and the direction of the load to which the cam is subjected. If the force to which the cam is subjected is substantial, the force which works in the direction to cause the projection to come out of the cam retention hole of the rotational shaft, is also substantial, making it possible for the projection to come out of the cam retention hole.

SUMMARY OF THE INVENTION

The present invention is related to a pressure applying device that has a rotational shaft with a cam retention hole and a cam having a projection to be fitted into the cam retention hole of the rotational shaft. The primary object of the present invention is to provide a pressure applying device where the projection of the cam is unlikely to come out of the cam retention hole of its rotational shaft, even if its rotational shaft deforms.

According to an aspect of the present invention, there is provided a pressing device for pressing an object. The pressing device includes a pressing lever, a side plate, a cam, and a snap fit portion. The pressing lever is rotatable about a fulcrum and configured to press the side plate supports the rotatable shaft. The cam is fixed on the rotatable shaft and has an outer peripheral surface including portions away from the rotational axis of the rotatable shaft by different distances. The cam is contactable to the pressing lever to cause the pressing lever to apply a pressure to the object. The snap fit portion includes, at its free end, an engaging portion engageable with a portion-to-be-engaged provided on the rotatable shaft to fix the cam and the rotatable shaft. The cam is provided on one side of the side plate with respect to a direction of the axis, and the snap fit portion is provided on the other side thereof. The portion-to-be-engaged has a phase not less than 90 degrees away from a portion of the outer peripheral surface of the cam where the distance between the rotational axis and the outer peripheral surface of the cam is maximum.

Further features of the present invention will become apparent from the following description of exemplary embodiments with reference to the attached drawings.

Figure 9:
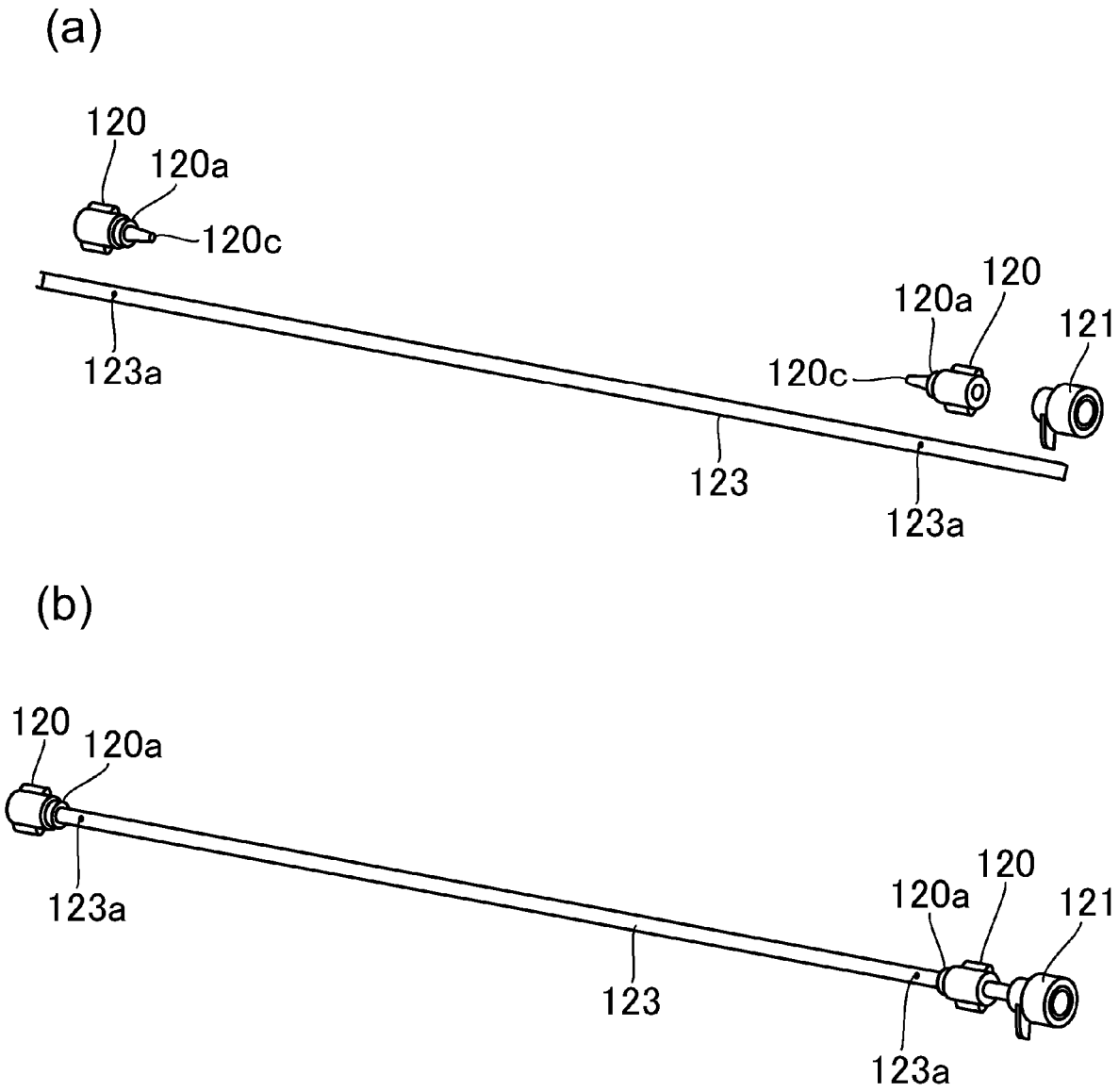

Part (a) of FIG. 9 is an exploded perspective view of a combination of a cam shaft, cam, and cam gear of the fixing device in the first embodiment, and part (b) of FIG. 9 is a perspective view of the assembled combination of the cam shaft, cam, and cam gear of the fixing device in the first embodiment.

Figure 10:
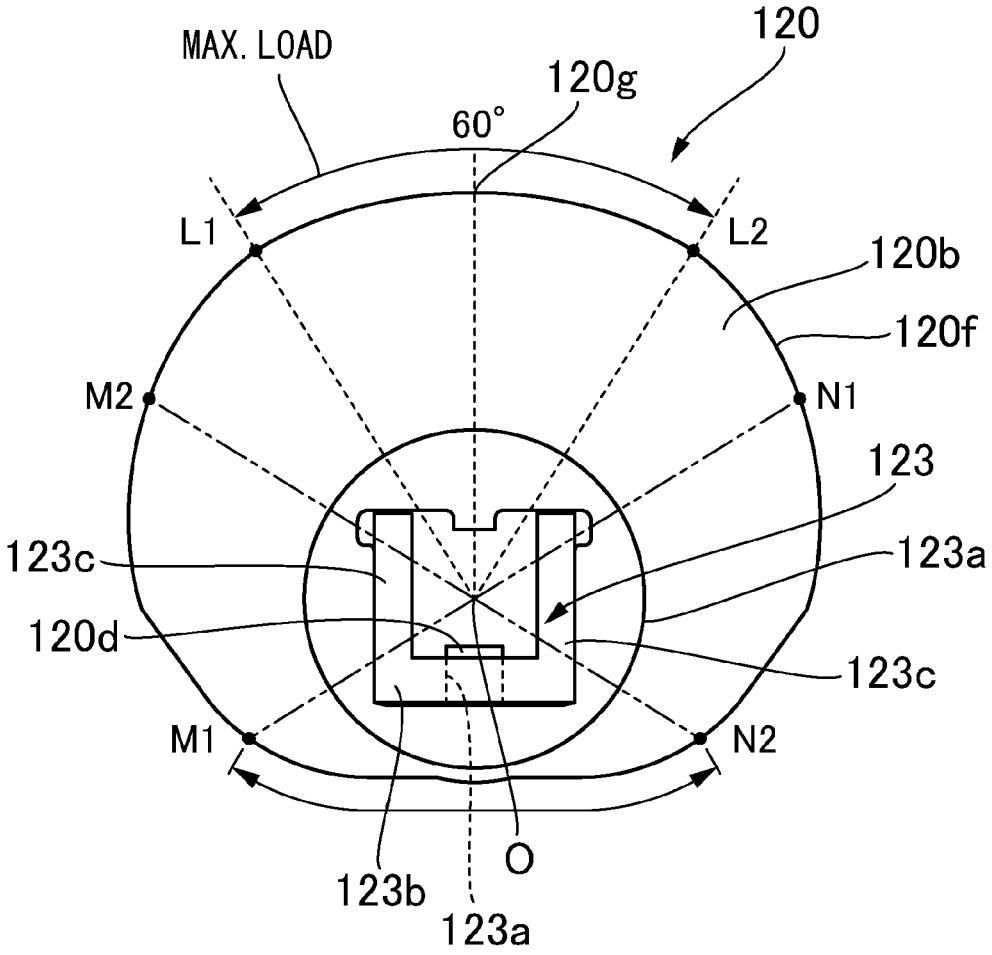

FIG. 10 is a side view of a combination of the cam shaft and cam in the first embodiment.

Figure 11:
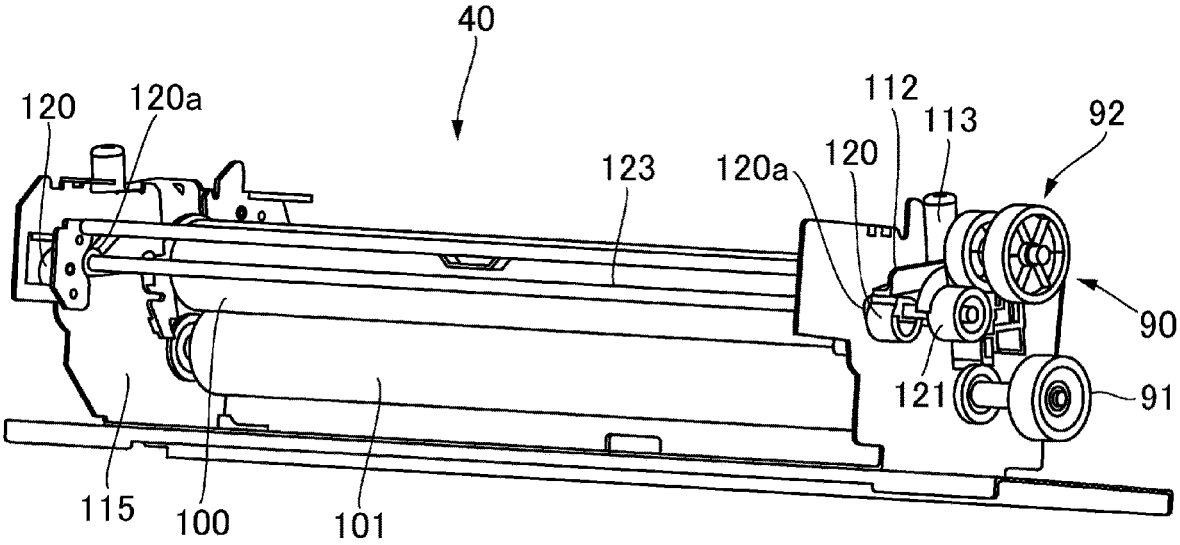

FIG. 11 is a schematic perspective view of the fixing device in the first embodiment, when the fixing device is applying pressure, showing the state of the fixing device when the fixing device is applying pressure.

Figure 12:
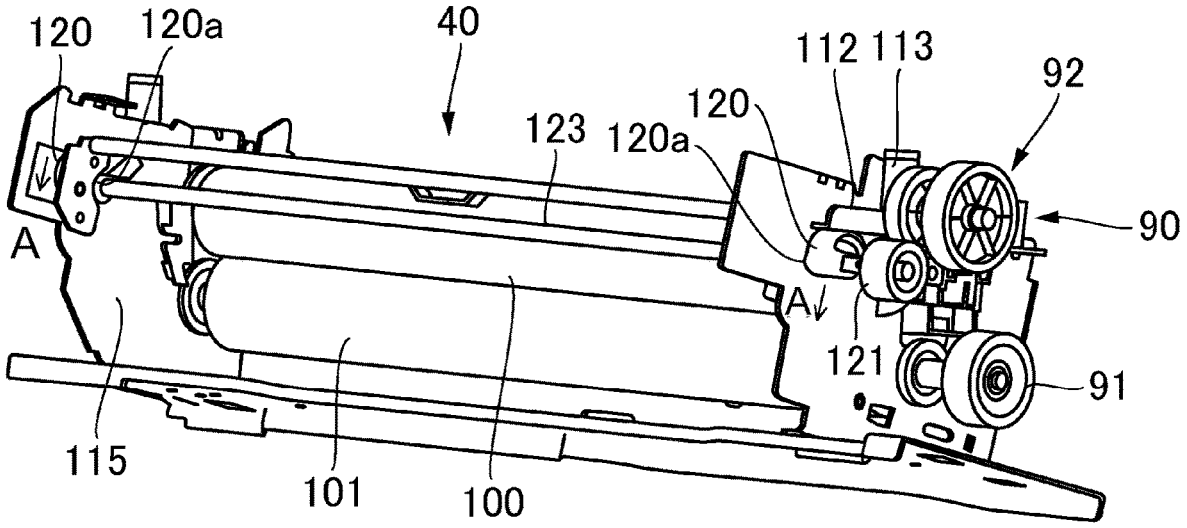

FIG. 12 is a schematic perspective view of the fixing device in the first embodiment, when the fixing device is not applying pressure, showing the state of the fixing device when the fixing device is not applying pressure.

Figure 13:
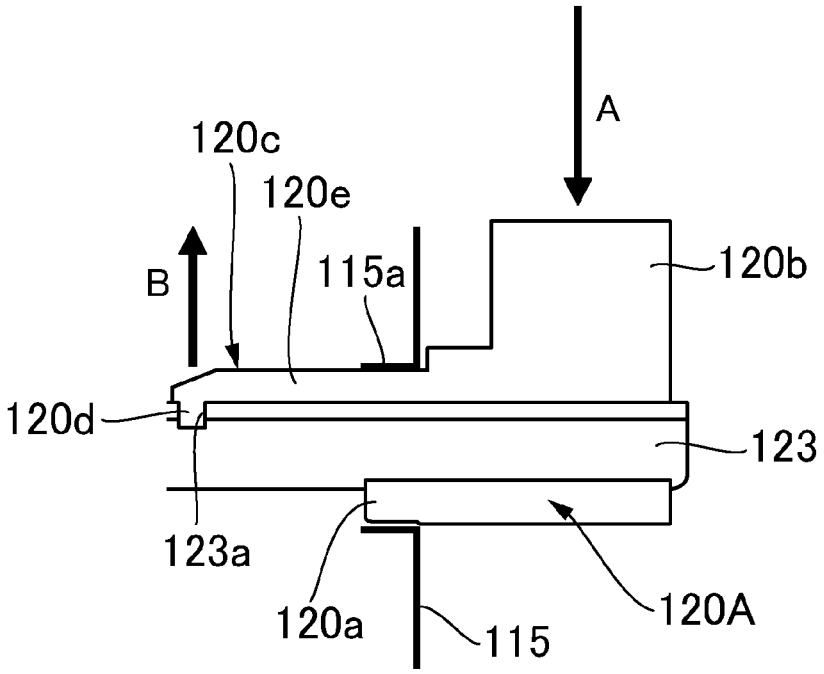

FIG. 13 is a schematic sectional view of an assembled combination of the cam and cam shaft of an example of a comparative fixing device.

Figure 14:
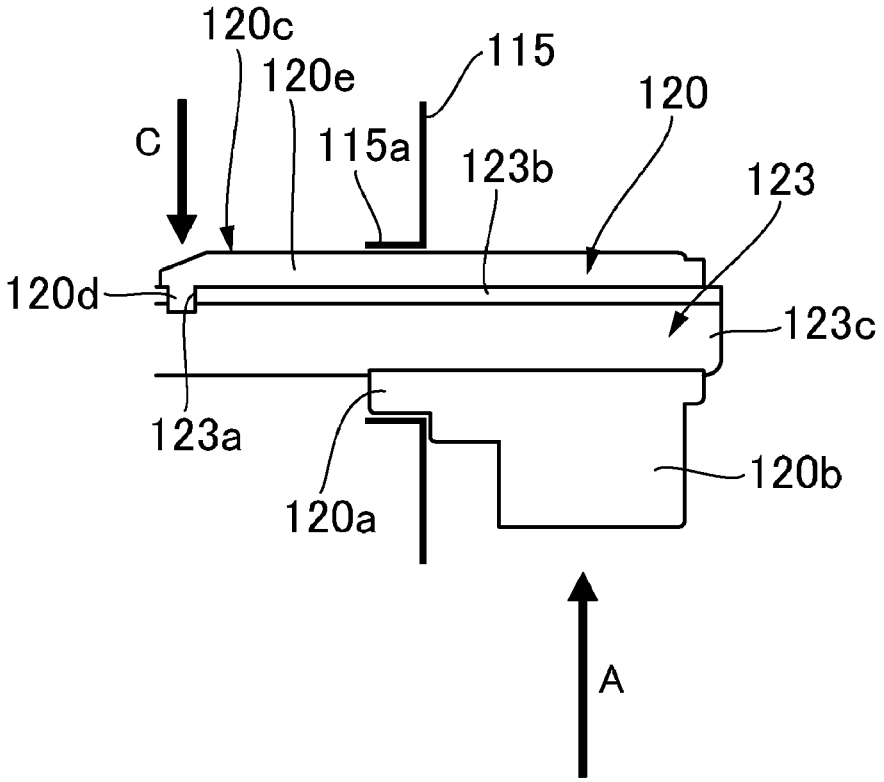

FIG. 14 is a schematic sectional view of an assembled combination of the cam and cam shaft of the fixing device in the first embodiment.

Figure 15:
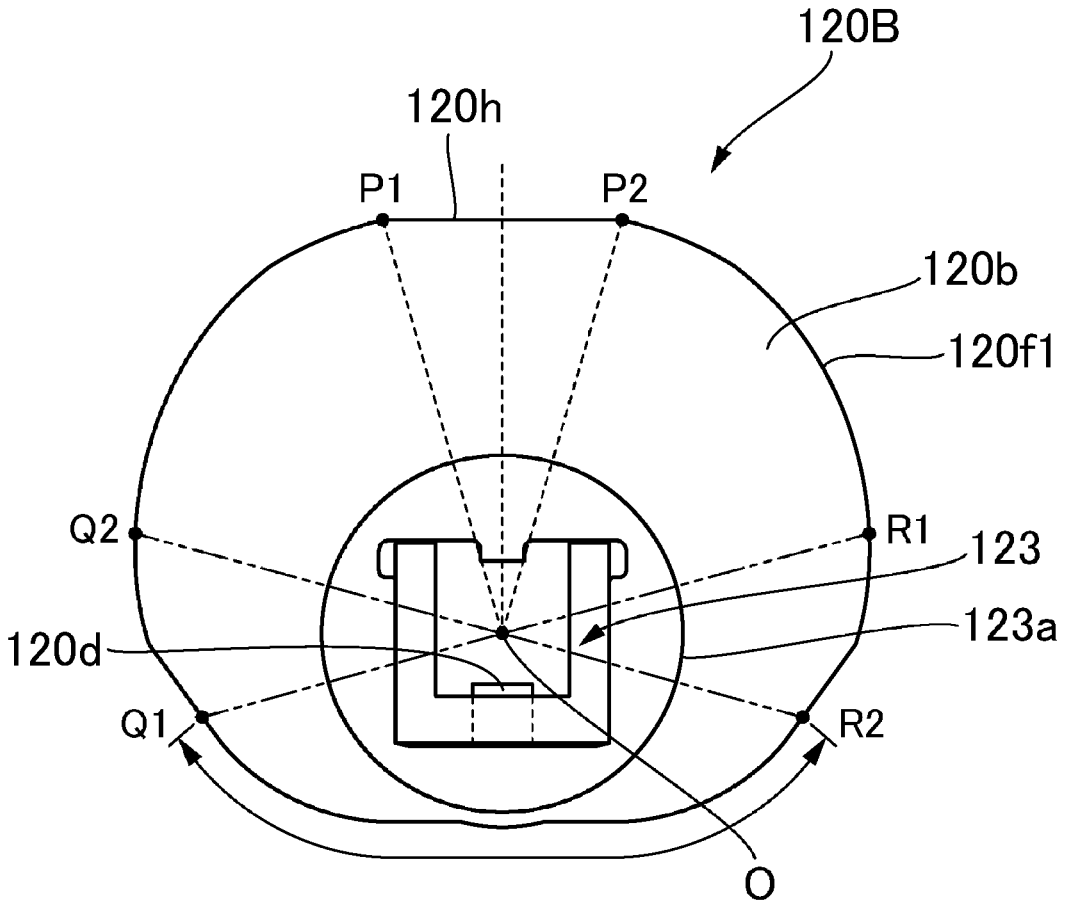

FIG. 15 is a side view of an assembled combination of the cam shaft and cam in a second embodiment of the present invention.

Figure 16:
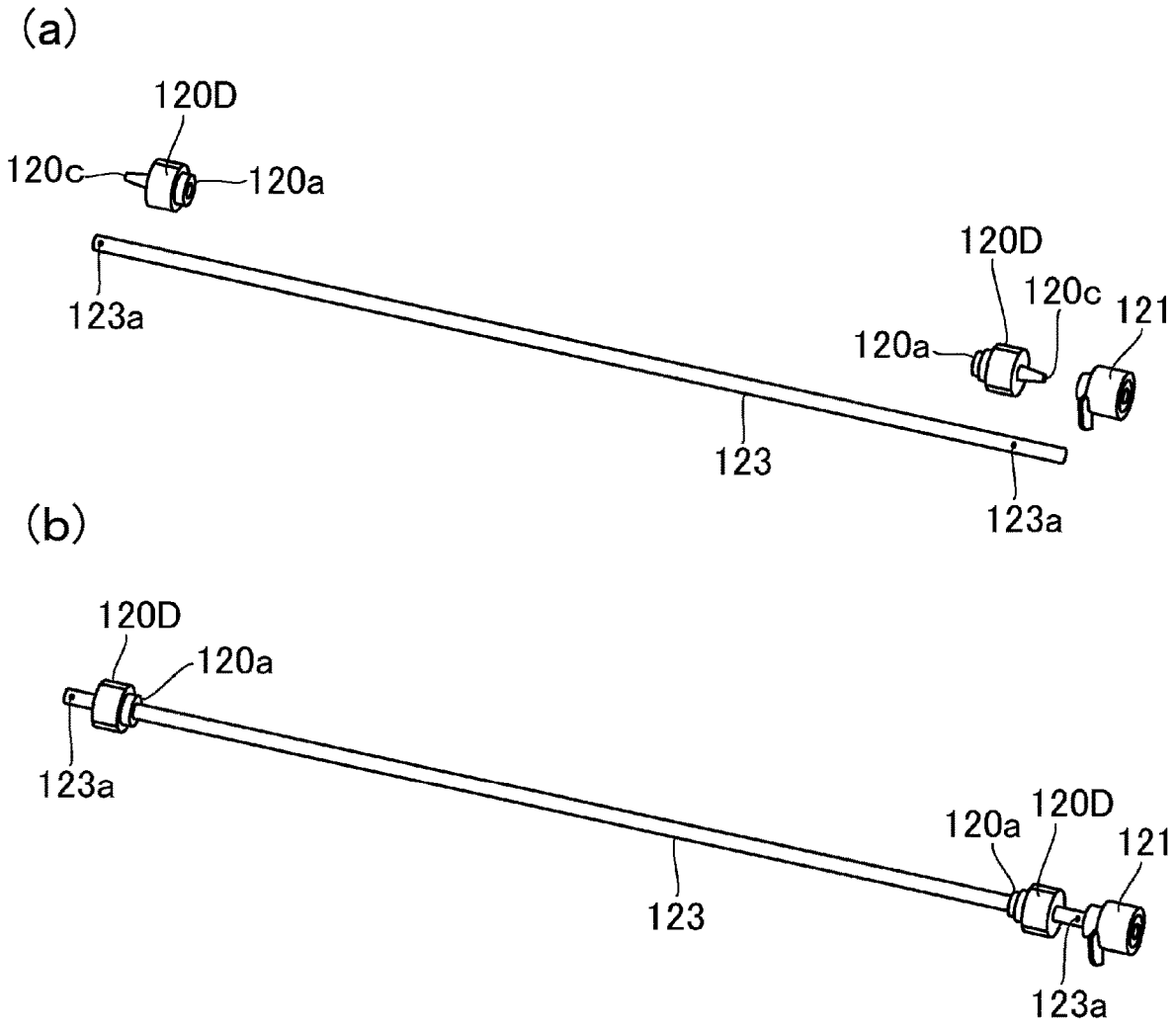

Part (a) of FIG. 16 is an exploded perspective view of a combination of a cam shaft, cam, and cam gear of the fixing device in the second embodiment, and part (b) of FIG. 16 is a perspective view of the assembled combination of the cam shaft, cam, and cam gear of the fixing device in the second embodiment.

Figure 17:
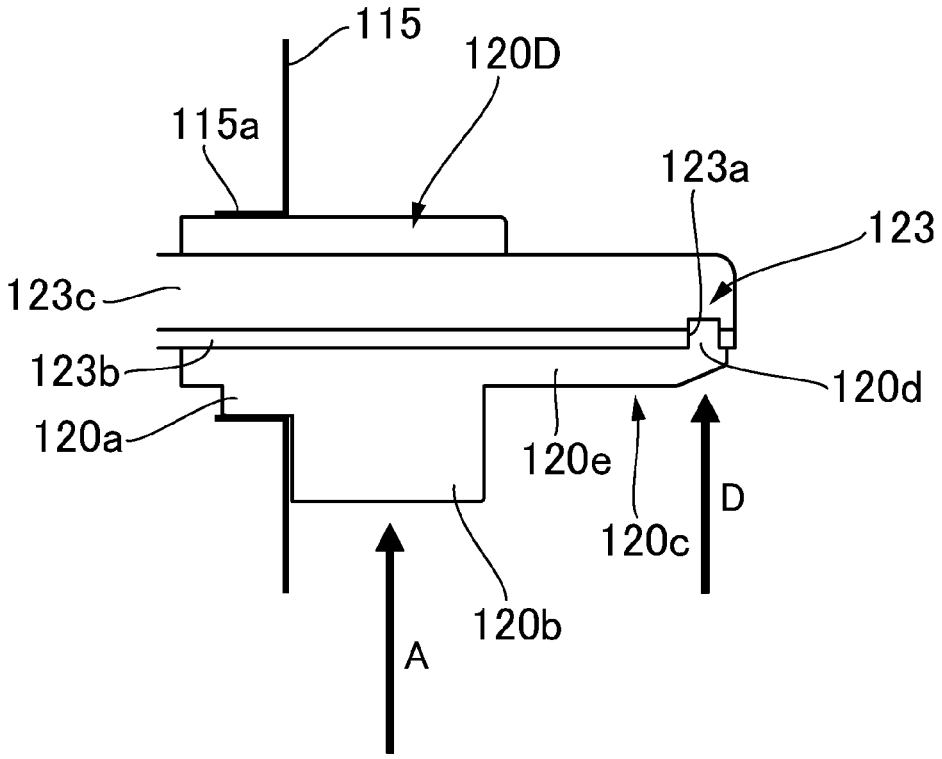

FIG. 17 is a sectional view of an assembled combination of a cam and cam shaft of a fixing device in a third embodiment of the present invention.

DESCRIPTION OF THE EMBODIMENTS

Embodiment 1

Referring to FIGS. 1-14, the first embodiment of the present invention is described. To begin with, referring to FIG. 1, the general structure of an image forming device 600 in this embodiment is described.

[Image Forming Apparatus]

Figure 1:
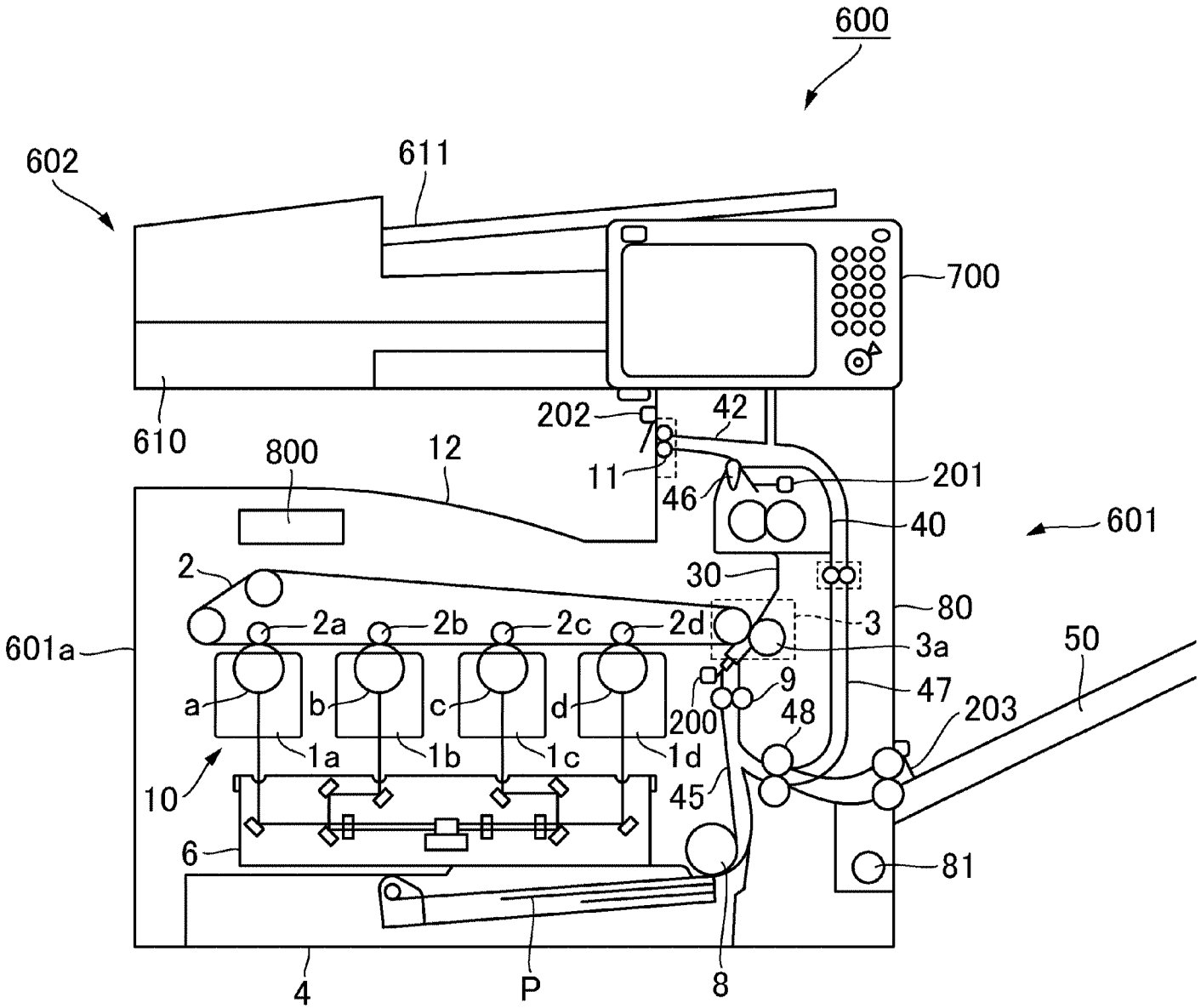
FIG. 1 is a schematic sectional view of an image forming apparatus in a first embodiment of the present invention, showing the general structure of the image forming apparatus.

FIG. 1 is a schematic sectional view of the image forming apparatus 600 in this embodiment, at a plane which is parallel to the direction in which a sheet P of recording medium is conveyed in the image forming apparatus 600. The image forming apparatus 600 is a digital color copying machine of the so-called tandem type. It has image formation units 1*a*, 1*b*, 1*c* and 1*d*, which form Y (yellow), M (magenta), C (cyan) and Bk (Black) images, respectively, and an intermediary transfer belt 2. The four image formation units 1*a*, 1*b*, 1*c* and 1*d* are aligned in tandem in the direction parallel to the rotational direction of the intermediary transfer belt 2. That is, it is of the so-called tandem type. By the way, the image forming apparatus 600 may be in the form of any of a copying machine, a printer, a facsimileing machine, and a multifunction machine having the functions of two or more of the preceding examples of image forming apparatus. A sheet P of recording medium is any recording medium which is in the form of a sheet. Examples of recording medium are ordinary paper, resinous paper which can be used in place of ordinary paper, cardstock, film for an overhead projector, etc.

The image forming apparatus 600 has an engine portion 601, an image reading portion 602, a control panel 700, and a control portion 800. The engine portion 601 forms an image (formed of toner) on a sheet P of recording medium. The image reading portion 602 reads an original placed above the engine portion 601. The control portion 700 is disposed on the front side of the image forming apparatus 600, being roughly in the middle of the engine portion 601. It is a portion through which an operator such as a user, a service person, or the like operates the image forming apparatus 600. The control portion 800 is disposed on the rear side of the engine portion 601. It controls the engine portion 601 and image reading portion 602 in their operations.

The image reading portion 602 has an original placement plate 610 and an automatic original feeding device 611 (ADF). The original placement plate 610 is a plate on which an original is to be placed. It reads the original on the original placement plate 610 with the use of its reading device (unshown). The ADF 611 is capable of feeding an original into the unshown original reading device. The data of the read original are converted into electrical signals, and are transmitted to a laser scanner 6 of the engine portion 601.

The engine portion 601 is equipped with an image forming portion 10 having the image formation units 1*a*-1*d*, which form Y (yellow), M (magenta), C (cyan) and Bk (black) toner images, respectively. The image formation units 1*a*-1*d* have photosensitive drums a-d, respectively, each of which is a cylindrical photosensitive member as an image bearing member. Each of the image formation units 1*a*-1*d* has an unshown charging device, an unshown developing device, and an unshown cleaning device, which are disposed in the adjacencies of the peripheral surface of the photosensitive drum. The photosensitive drums a-d are charged by the corresponding charging devices. Then, an electrostatic latent image, which is in accordance with the data of the original read by the engine portion 601, is formed on the charged peripheral surface of each photosensitive drum, by the laser scanner 6 (exposing device). The electrostatic latent images on the photosensitive drums a-d, one for one, are developed by the corresponding developing devices which contain Y (yellow), M (magenta), C (cyan) and Bk (black) toners, one for one, into visible images, that is, yellow, magenta, cyan and black images formed of toner. Then, the yellow, magenta, cyan, and black toner images on the photosensitive drums a-d are sequentially transferred onto the intermediary transfer belt 2 as an intermediary transferring member, by primary transfer rollers 2*a*-2*d*, respectively.

Meanwhile, multiple sheets P of recording medium are moved out of a sheet feeder cassette 4, one by one, by a feed roller 8. Then, each sheet P is sent to a pair of registration rollers 9 through a sheet conveyance passage 45. The pair of registration rollers 9 catch the sheet P, while remaining stationary, to correct the attitude of the sheet P in (if it happens to be askew). Then, they send the sheet P into a secondary transferring portion 3, which is the interface between the intermediary transfer belt 2 and a secondary transfer roller 3*a*, in synchronism with the arrival of the toner image on the intermediary transfer belt 2 at the secondary transferring portion 3.

The color toner image on the intermediary transfer belt 2 is transferred onto the sheet P by the secondary transfer roller 3*a* as a transferring member. Thereafter, the sheet P and toner image thereon are conveyed further through a sheet passage 30 to a fixing device 40, in which they are heated and pressed. As a result, the toner image on the sheet P is fixed to the sheet P.

In a case where a toner image is to be formed on only one of the two surfaces of the sheet P, a switching member 46 is changed in position so that the sheet P is discharged into a delivery tray 12 by way of a pair of discharge roller 11 as it comes out of the fixing device 40. In a case where a toner image is to be formed on both surfaces of the sheet P, the sheet P is not directly delivered into the delivery tray 12 by the pair of discharge rollers 11 after it comes out of the fixing device 40. Instead, as the upstream edge of the sheet P in terms of the sheet conveyance direction reaches a reversal point 42 while being conveyed by the pair of discharge rollers 11 after fixation of the toner image to the sheet P by the fixing device 40, the discharge rollers 11 are reversed in rotation so that the sheet P is conveyed backward into a sheet passage 47 for the two-sided printing. Then, the sheet P is put through the same process as the one for the one-sided printing. As a result, a toner image is formed on the second surface of the sheet P. Then, the sheet P is discharged into the delivery tray 12.

By the way, the portion of the image forming apparatus 600, which comprises the switching member 46 and discharge rollers 11, is an example of a reversing mechanism. In the case of the reversing mechanism in this embodiment, the pair of discharge rollers 11 are utilized to flip the sheet P. However, from the standpoint of improving the image forming apparatus 600 in productivity, the image forming apparatus 600 may be provided with a dedicated sheet flipping portion instead of the discharge rollers 11, to convey the sheet P backward, or the image forming apparatus 600 may be provided with two discharging portions so that one of them can be dedicated to the reversal conveyance of the sheet P.

The image forming apparatus 600 is provided with a manual sheet feeding portion 50, in addition to the sheet feeder cassette 4. The manual sheet feeding portion 50 is attached to the outward side of the side wall of the engine portion 601. The manual sheet feeding portion 50 is provided to improve the image forming apparatus 600 in usability. For example, the provision of the manual sheet feeding portion 50 makes it easier for a user to use a sheet P of recording medium which is different in type and/or size from the one set in the sheet feeder cassette 4 when a user wants to form an image on a sheet P of recording medium which is different from the one in the sheet feeder cassette 4. Also in a case of an image forming operation which uses the manual sheet feeding portion 50, each sheet P is conveyed through the sheet conveyance passage 45 as in the case of an image forming operation in which a sheet P is fed from the sheet feeder cassette 4.

By the way, the manual sheet feeding portion 50 is provided with a manual feed sensor 203 which detects the presence or absence of a sheet P of recording medium, making it possible for the image forming apparatus 600 to detect the presence or absence of a sheet P of recording medium in the manual sheet feeding portion 50. Further, the image forming apparatus 600 is provided with sensors, which are disposed in the sheet passages, as parts of the system for detecting the state of a sheet P while the sheet P is being conveyed through the sheet passages. For example, the state of a sheet P on the downstream side of the pair of registration rollers 9 is detected by a registration sensor 200, whereas the state of the sheet P on the downstream side of the fixing device 40 is detected by an inward discharge sensor 201. Further, the state of the sheet P on the downstream side of the pair of discharge rollers 11 is detected by an outward discharge sensor 202. The control portion 800 receives sheet detection signals from each sensor, and selects the next step according to the received sheet detection signals.

For example, if the length of time any of the abovementioned sensors is remaining on while a sheet P of recording medium is being conveyed through a sheet passage is longer than a value preset for a given sequence, or the arrival of a sheet P of recording medium at a given sensor is later than a preset point in time for a given operational sequence, the control portion 800 determines that the sheet P is stuck somewhere in one of the sheet passages. Then, it stops the driving portion (unshown) for each roller, based on the received sheet detection signals, in order to prevent the image forming apparatus 600 from worsening in the state of sheet jam.

A main assembly 601*a* of the image forming apparatus 600 (which hereafter will be referred to as "apparatus main assembly" 601*a*) is provided with a door 80 for allowing a stuck sheet P of recording medium to be removed after the detection of the stuck sheet P of recording medium in any of the sheet passages in the apparatus main assembly 601*a* (which hereafter may be referred to as "paper jam", or simply "jam") by one of the sensors. The door 80 is pivotally openable about a hinge 81 in the rightward direction of FIG. 1. It is positioned on one side (right side in FIG. 1) of the sheet passage 30, secondary transfer roller 3*a*, and pair of registration rollers 9. As the door 80 is opened, a sheet conveyance passage from the sheet passage 45 to the pair of discharge rollers 11, except for the fixing device 40, is exposed.

[Fixing Device]

Next, referring to FIGS. 2-5, the structure and mechanism of the fixing 40 in this embodiment is described. The fixing device 40 has a fixation belt 100 as a first rotational member, a pressure roller 101 as a second rotational member, a heater 102 (FIGS. 4 and 5) as a heat source, a pressure applying device 110, etc.

The fixation belt 100 is a thin and endless belt. The pressure roller 101 forms a fixation nip N which heats the toner image on a sheet P of recording medium while the sheet P is conveyed through the nip N, remaining pinched between the fixation belt 100 and pressure roller 101. The fixation belt 100 is guided by a pair of belt guides 105, by its edges, that is, its lengthwise ends (in terms of direction which is intersectional to rotational direction of fixation belt 100, that is, direction parallel to rotational axis of pressure roller 101). The pressure roller 101 is rotationally driven by a combination of a fixation motor 93, and a fixing device driving portion 90. The fixation belt 100 is rotated by the rotation of the pressure roller 101.

The heater 102 is on the inward side of the loop which the fixation belt 100 forms. It heats a sheet P of recording medium as the sheet is moved through the fixation nip N. In this embodiment, the heater 102 includes a heat generating member (heat generating resistor) as a heat source which generates heat as it is supplied with electrical power. It increases in temperature as its heat generating member generates heat. The heater 102 is held by a pressure applying portion 103, which also is disposed on the inward side of the loop which the fixation belt 100 forms. As the fixation belt 100 is moved while remaining pinched between the heater 102 and pressure roller 101, the heater 102 is rubbed by the fixation belt 100.

By the way, the surface of the fixation belt 100, which rubs the heater 102, and the surface of the pressure applying portion 103, which is rubbed by the fixation belt 100, and the surface of the heater 102, which is rubbed by the fixation belt 100, are coated in advance with lubricant (unshown) to reduce the friction between the fixation belt 100 and pressure applying portion 103, and the friction between the fixation belt 100 and heater 102. In this embodiment, oil is used as the lubricant to be applied between the pressure applying portion 103 and fixation belt 100, and between the heater 102 and fixation belt 100. As this lubricant oil, silicone oil or the like, which is usable in a high temperature-high humidity environment, is desirable.

The pressure applying device 110 pressures the fixation belt 100 against the pressure roller 101. That is, the pressure applying device 110 pressures the fixation belt 100 against the pressure roller 101 with the use of a combination of a compression spring 113 and a pressure lever 112, as will be described later in detail. More concretely, the pressure lever 112 which is under the pressure from the compression spring 113 pressures the fixation belt 100 against the pressure roller 101 with the presence of the pressure applying portion 103 between the pressure lever 112 and fixation belt 100, so that a preset amount of pressure is maintained between the pressure applying portion 103 and pressure roller 101 with the presence of the fixation belt 100 between the pressure applying portion 103 and pressure roller 101.

In the case of the fixing device 40 in this embodiment, which is structured as described above, a sheet P of recording medium, which is bearing an unfixed toner image, is conveyed through the fixation nip N between the fixation belt 100 and pressure roller 101. While the sheet P is conveyed through the fixation nip N, thermal energy is given to the sheet P (and unfixed toner image thereon) from the heater 102 through the fixation belt 100. Consequently, the unfixed toner image on the sheet P is welded (fixed) to the sheet P. After the conveyance of the sheet P through the fixation nip N, the sheet P is separated from the fixation belt 100, and is discharged. Next, various members, portions thereof, etc. of the fixing device 40 are described in greater detail.

[Fixation Belt]

In order to minimize the fixation belt 100 in thermal capacity to minimize the fixing device 40 in the length of time it takes to start up, the fixation belt 100 is formed of resinous film such as polyimide film, PEEK film, or the like, which is no more than 150 μm in overall thickness. The fixation belt 100 is made up of a substrative layer formed of a resinous substance, an elastic layer layered on the substrative layer, and a release layer, as a surface layer, layered on the elastic layer. The elastic layer is formed of a resinous substance, to which an electrically conductive substance has been added for electrical conductivity. The fixation belt 100 is endless, and is 25 mm in internal diameter.

In this embodiment, polyimide film which is 30 μm in thickness was used as the material for the substrative layer. The elastic layer was 70 μm in thickness. It was formed of silicone rubber which was 1.0 W/m·K in thermal conductivity. The release layer was formed of a piece of PFA tube which was 30 μm in thickness. The release layer is desired to be formed of a sheet of such a material that is superior in releasing property, or a coated layer of such a material. For example, fluorine resin can be used as the material for the release layer. Further, the fixation belt 100 may be made by layering an electrically conductive layer and a release layer on a substrative layer formed of polyether, polyethylene-terephthalate, polyimide-amide, or the like which is highly heat resistant.

[Pressure Roller]

The pressure roller 101 comprises a cylindrical metallic core, an elastic layer as a middle layer, and a release layer as the surface layer. The metallic core is formed of such a metallic substance as iron and aluminum. The elastic layer is formed around the metallic core, of a soft and rubbery substance such as sponge and silicone rubber. The release layer as the surface layer is formed of PFA. In this embodiment, the surface of the metallic core formed of iron, aluminum, or the like is roughened by blasting or the like method, and then, was washed clean. Then, the metallic core was inserted into a cylindrical mold. Then, liquid silicone rubber was poured into the gap between the metallic core and cylindrical mold. Then, a combination of the mold, metallic core, and liquid silicone rubber was heated to harden the silicone rubber. Prior to this process, a piece of tube formed of PFA or the like, coated with primer on the inward side in advance is inserted into the cylindrical mold in order to form the release layer. Thus, as the combination is heated, the piece of tube and rubber layer adhere to each other. After the heating of the combination, the pressure roller 101 is removed from the mold, and then, is cured for the second time.

In the case of the pressure roller 101 in this embodiment, the metallic core is 15 mm in diameter. The elastic layer is formed of silicone rubber, is 5 mm in thickness, and 64° in Asker hardness scale. The release layer is formed of a piece of PFA tube, and is 50 μm in thickness. Further, the pressure roller 101 is roughly 25 mm in diameter.

[Heater]

The heater 102 is a ceramic heater. It is roughly in the form of a long, narrow, and thin rectangular parallelepiped. As for the method for manufacturing the heater 102, first, Ag/Pd paste is applied to the surface of a long, narrow, and thin substrative plate formed of AlN which is excellent in thermal conductivity, by thick film printing method, and then, the combination of the substrative plate and Ag/Pd paste thereon is sintered to form a heat generating member. Then, a layer of glass, which is roughly 50-60 μm in thickness is placed as a friction-reducing and electrically insulative layer, on the heat generating member to yield a ceramic heater. In this embodiment, the heater 102 is formed by placing a heat generating and electrically resistive layer on a substrate which is formed of AlN and is 600 μm in thickness.

Further, on the opposite surface of the AlN substrate from the surface which has the heat generating member, there is provided a thermistor which is in the form of a chip. The thermistor is fixed to the patterned electrode formed in advance by thick-film printing on an area of the opposite surface of the substrate from where the heating member is, with the use of adhesive. It monitors the temperature of the AlN substrate. Further, there is also provided a thermistor in the adjacencies of the end portion of the heating member. This thermistor has to detect such temperature that is higher than a temperature level which adhesive can withstand. Therefore, it is held to the substrate by a preset amount of pressure with the use of such an unshown pressing means as a spring.

[Belt Guide]

Figure 4:
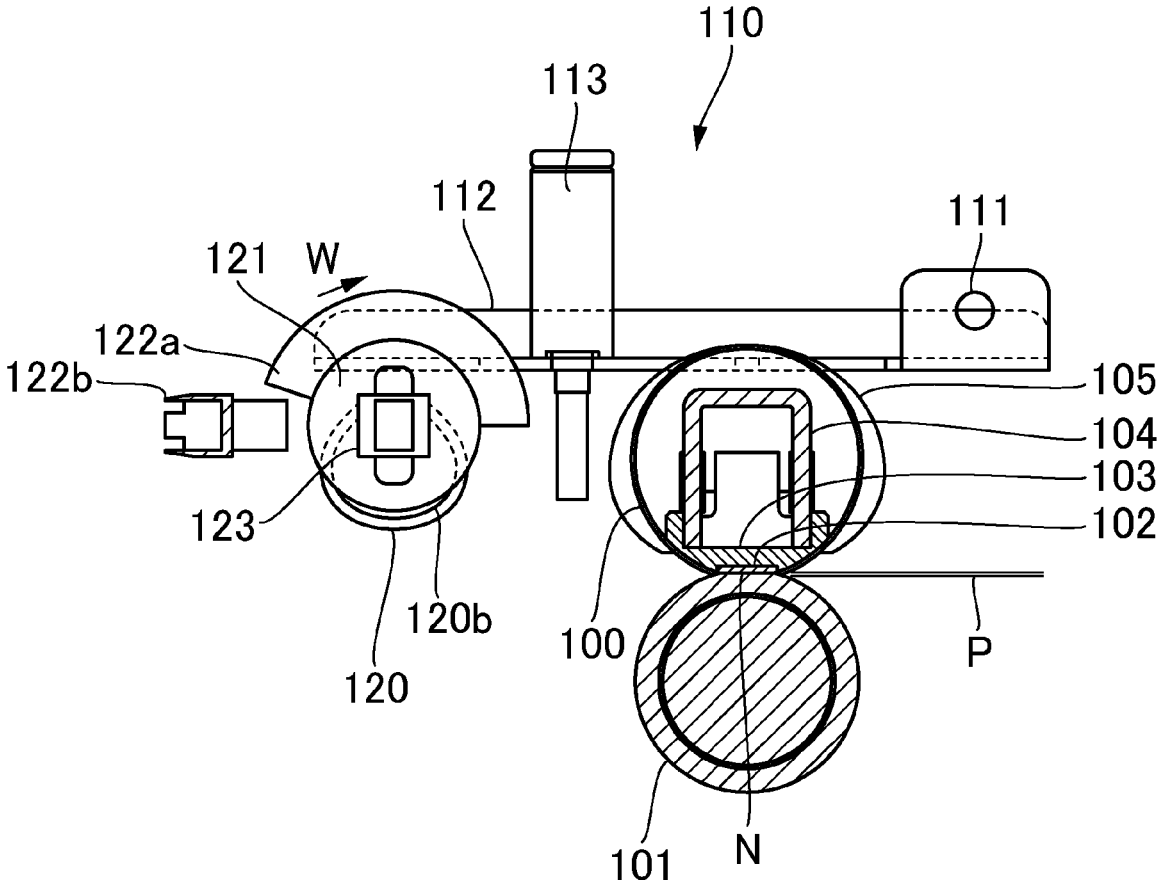
FIG. 4 is a schematic drawing of portions of the pressure applying device and the fixing device in the first embodiment when pressure is being applied.
Figure 5:
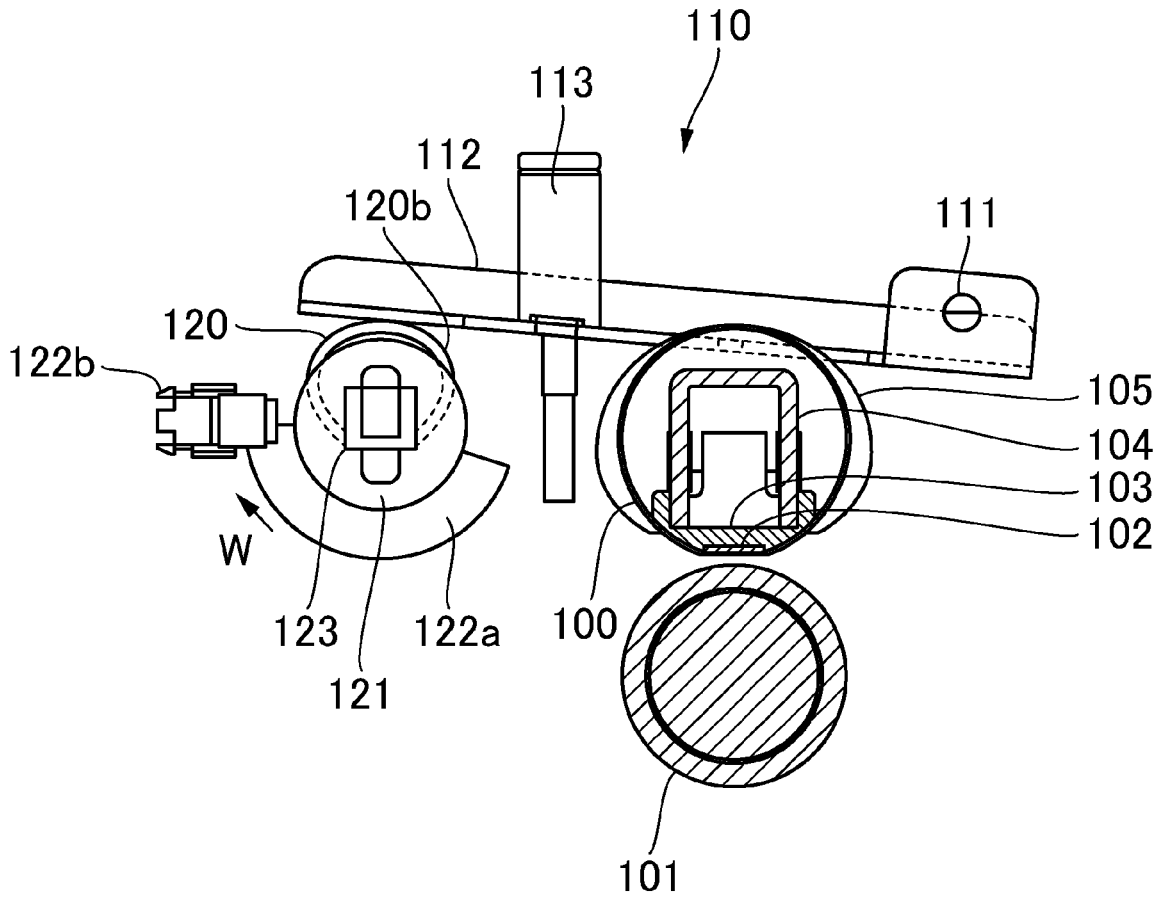
FIG. 5 is a schematic drawing of the portions of the pressure applying device and the fixing device in the first embodiment when pressure is not being applied.

The belt guide 105 is a regulating member. It is positioned at each of the widthwise ends of the fixation belt 100. It regulates the fixation belt 100 in the widthwise movement, and also, in the shape of the fixation belt 100 in terms of the cross section at a plane perpendicular to the widthwise direction of the fixation belt 100. Referring to FIGS. 4 and 5, the belt guide 105 supports a belt frame 104 which is disposed on the inward side of the loop (belt loop) which the fixation belt 100 forms, and the pressure applying portion 103 which pressures the fixation belt 100 toward the pressure roller 101. The belt guide 105 is formed of such heat resistant resin as PPS, liquid polymer, and phenol resin. It bears the pressure from the pressure applying device 110 while supporting the fixation belt 100 by widthwise end portion of the fixation belt 100.

The belt frame 104 is a member which bears the force (reaction force) from the pressure roller 101. It is desired to be formed of such a substance that is unlikely to deform even if it is subjected to a substantial amount of pressure. In this embodiment, SUS 304 is used as the material for the belt frame 104.

The pressure applying portion 103 is a nip forming member, to which the heater 102 is fixed to be supported by the pressure applying portion 103. It is in the form of a trough which is roughly semicircular in cross section. It is a heat resistant member formed of heat resistant resin or the like. It is positioned in such an attitude that its lengthwise direction is perpendicular to the sheets of paper on which FIGS. 4 and 5 are, one for one. From the standpoint of energy conservation, it is desired that such a substance that is low in the thermal conductivity to the belt frame 104 is used as the material for the pressure applying portion 103. For example, heat resistant glass, polycarbonate, liquid polymer, or the like heat resistant resin is desirable.

The fixation belt 100 is loosely fitted around the combination of the pressure applying portion 103 and heater 102. It is supported by the pair of belt guides 105, by its widthwise end portions. The belt guide 105 is supported by a fixation device frame 115, as a supporting member, in such a manner that it is allowed to freely move in the direction parallel to the direction of the pressure application. As for the pressure roller 101, it is supported by the fixing device frame 115, with the placement of a pair of pressure roller bearings 114 (FIG. 3) between the lengthwise end portions of the shaft of the pressure roller 101, and fixation device frame 115, one for one.

The fixation belt 100 is supported by the pressure lever 112, with the presence of the combination of the belt frame 104 and belt guide 105 between the fixation belt 100 and pressure lever 112. The pressure lever 112 is supported by a pivot 111 so that it is pivotally movable about the pivot 111. It is under the pressure generated by the compression spring 113 in the direction to pressure the fixation belt 100 upon the pressure roller 101. By the way, in this embodiment, the amount of pressure which each of the two compression springs 113 generates is set to 150 N. That is, the fixation belt 100 is pressured upon the pressure roller 101 by a total amount of pressure of 300 N.

[Fixation Device Driving Portion]

Figure 2:
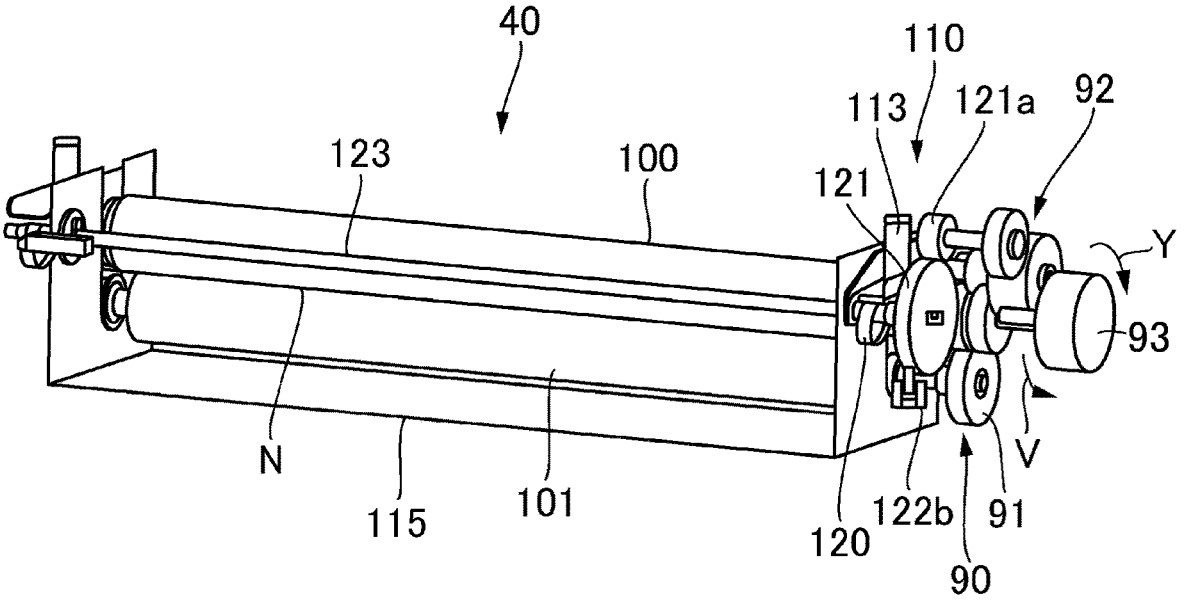
FIG. 2 is a schematic perspective view of a fixing device in the first embodiment, showing the general structure of the fixing device.

Referring to FIG. 2, the fixing device driving portion 90 has multiple gears for transmitting the rotational driving force from the fixation motor 93 to the pressure roller 101 or pressure applying device 110. More concretely, it has a roller gear 91, a cam gear 121, a gear 121*a* which is in mesh with the cam gear 121, and a gear train 92 comprising multiple gears for transmitting the driving force from the fixation motor 93 to the roller gear 91 and gear 121*a*. The roller gear 91 is attached to one of the lengthwise ends of the pressure roller 101. The cam gear 121 is attached to one of the lengthwise ends of a cam shaft 123 of the pressure applying device 110 which will be described later.

There are provided on the inward sides of the roller gear 91 and cam gear 121, one-way clutches, one for one, (unshown). Therefore, as the fixation motor 93 rotates in the direction indicated by an arrow mark Y, its driving force is transmitted to the pressure roller 101, but not to the cam gear 121. On the other hand, as the fixation motor 93 rotates in the direction indicated by an arrow mark V, its driving force is transmitted to the cam gear 121, but not to the pressure roller 101. That is, the fixing device driving portion 90 is structured so that whether the pressure roller 101 or cam shaft 123 is to be rotated is set by changing the fixation motor 93 in the rotational direction.

In an ordinary image forming operation, a sheet P of recording medium is conveyed through the fixing device 40 by rotating the fixation motor 93 in the direction indicated by the arrow mark Y to transmit the driving force to the pressure roller 101. However, in an operation for applying pressure to the pressure roller 101 with the use of the pressure applying device 110, or an operation to stop applying the pressure, the fixation motor 93 is rotated in the direction indicated by the arrow mark V to transmit the driving force to the cam gear to rotate the cam shaft 123, and the cam fixed to the cam shaft 123.

[Pressure Applying Device]

Figure 3:
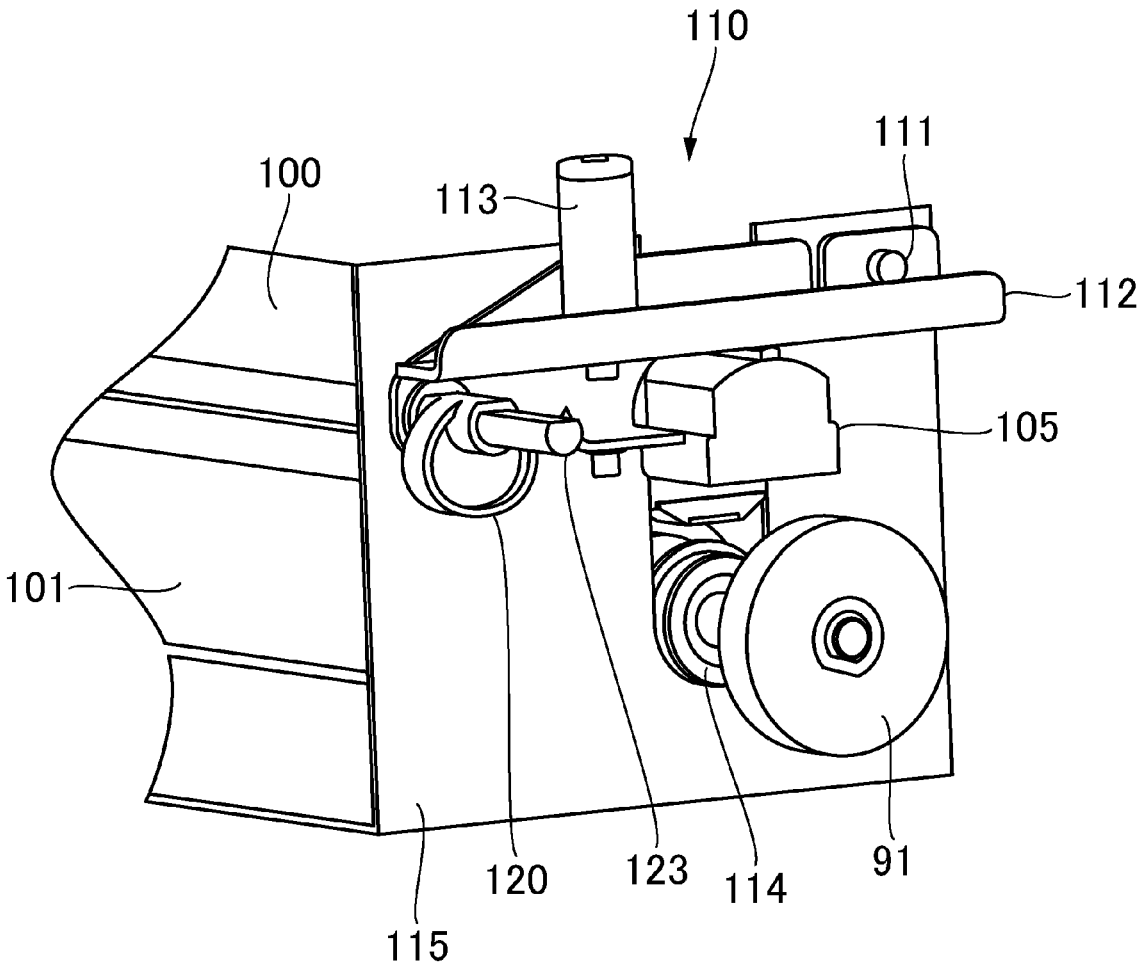
FIG. 3 is a perspective view of one of lengthwise end portions of the fixing device in the first embodiment that has a pressure applying device.

Next, referring to FIGS. 3-5, the pressure applying device 110 is described. The pressure applying device 110 has the compression spring 113, pressure lever 112, cam shaft 123, cam 120, and fixation device frame 115. The pressure lever 112, which is a pressure applying member, is supported by the fixation device frame 115 in such a manner that it is pivotally movable about the pivot 111. That is, the pressure lever 112 is allowed to pivotally move with the belt guide 105 which supports the fixation belt 100, about the pivot 111. Further, the pressure lever 112 is under the pressure generated downward of FIGS. 4 and 5 by the compression spring 113. That is, the pressure lever 112 is under the pressure generated by the compression spring 113. Therefore, the fixation belt 100 supported by the combination of the belt guide 105 and belt frame 104 is pressured toward the pressure roller 101.

The cam shaft 123 is a rotational shaft. It is positioned in parallel to the widthwise direction of the fixation belt 100. It is rotatably supported by the fixation device frame 115, by its lengthwise end portions, with the placement of the cam 120 between the fixation device frame 115 and cam shaft 123. The fixing device 40 is provided with two cams 120, which are fixed to the lengthwise end portions of the cam shaft 123, one for one. Each cam 120 is in contact with the corresponding pressure lever 112. The amount of the load which the cam 120 is made to bear, by the pressure lever 112 changes depending on the rotational phase of the cam 120. That is, the cam 120 is provided with a lever pressing portion 120*b*, which pressures the pressure lever 112. The structure of the combination of the cam 120 and cam shaft 123 is described later in detail, in particular, how the cam 120 is attached to the cam shaft 123.

As the cam 120 is rotated by the fixation motor 93 by way of the combination of the gear 121*a* and cam gear 121 (FIG. 2), the pressure lever 112 pivotally moves about the pivot 111. More concretely, referring to FIG. 4, when the rotational phase of the cam 120 is such that the cam 120 is not in contact with the pressure lever 112, the pressure lever 112 is made to press the belt guide 105 downward by the resiliency of the compression spring 113. Thus, the fixation belt 100 is pressed on the pressure roller 101 in such a manner that a preset amount of pressure is generated between the fixation belt 100 and pressure roller 101, forming thereby the fixation nip N.

On the other hand, as the cam 120 is rotated to the position shown in FIG. 5, it pushes up the pressure lever 112 against the resiliency of the compression spring 113. Consequently, the fixation belt 100 is moved in the direction to separate from the pressure roller 101, by the belt guide 105, stopping pressing on the pressure roller 101. That is, the fixing device 40 is structured so that it changes in the amount of the pressure applied by the pressure lever 112 to the fixation belt 100 to press the fixation belt 100 against the pressure roller 101, depending on the rotational phase of the cam 120. In this embodiment, when the fixing device 40 is in the pressure free state, the pressure for pressing the fixation belt 100 upon the pressure roller 101 is zero.

By the way, the pressure cancelling operation described above is carried out in the following situation. To begin with, it is carried out as the image forming apparatus 600 is jammed by a sheet P of recording medium; it is carried out to remove a jammed sheet P of recording medium. When the image forming apparatus 600 is not in an image forming operation, the pressure is kept away from the fixation belt 100, because if the fixing device 40 is left in a state in which the fixation belt 100 is kept pressed upon the pressure roller 101 longer than a preset length of time, while the fixation belt 100 and pressure roller 101 is left stationary, it is possible that the fixation belt 100 and/or pressure roller 101 will suffer from compression damages.

In this embodiment, the fixing device 40 is provided with a system for detecting whether the cam 120 is in a pressure application phase, or pressure removal phase. More specifically, the fixing device 40 is provided with a flag 122*a*, and a contact/separation sensor 122*b* which is capable of detecting the flag 122*a*. The flag 122*a* is an integral part of the cam gear 121, and is coaxial with the cam shaft 123. It rotates in synchronism with the cam 120. The contact/separation sensor 122*b* detects the position of the flag 122*a* in terms of the rotational direction of the cam 120. It is provided with a gap through which a beam of infrared light traverses. It sends out signals as the flag 122*a* blocks the beam or allows the beam to pass. In this embodiment, the fixing device 40 is structured so that when the cam 120 is in the pressure application phase, the flag 122*a* does not block the beam of infrared light as shown in FIG. 4, whereas when the cam 120 is in the no pressure application phase, the flag 122*a* blocks the beam of the contact/separation sensor 122*b*.

[Control of Pressure Applying Operation and Pressure Removing Operation]

Figure 6:
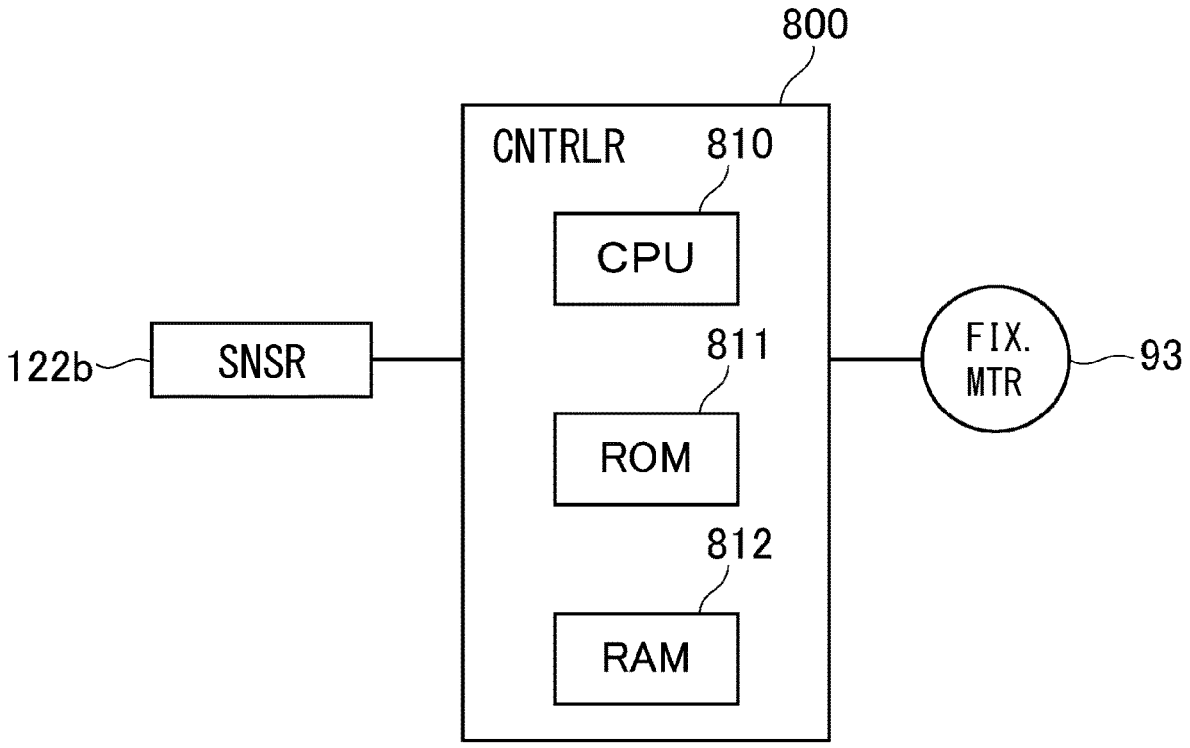
FIG. 6 is a block diagram of a control portion, in the first embodiment, for causing the fixing device to carry out a pressure applying operation, or causing the fixing device to carrying out a pressure removing operation.
Figure 7:
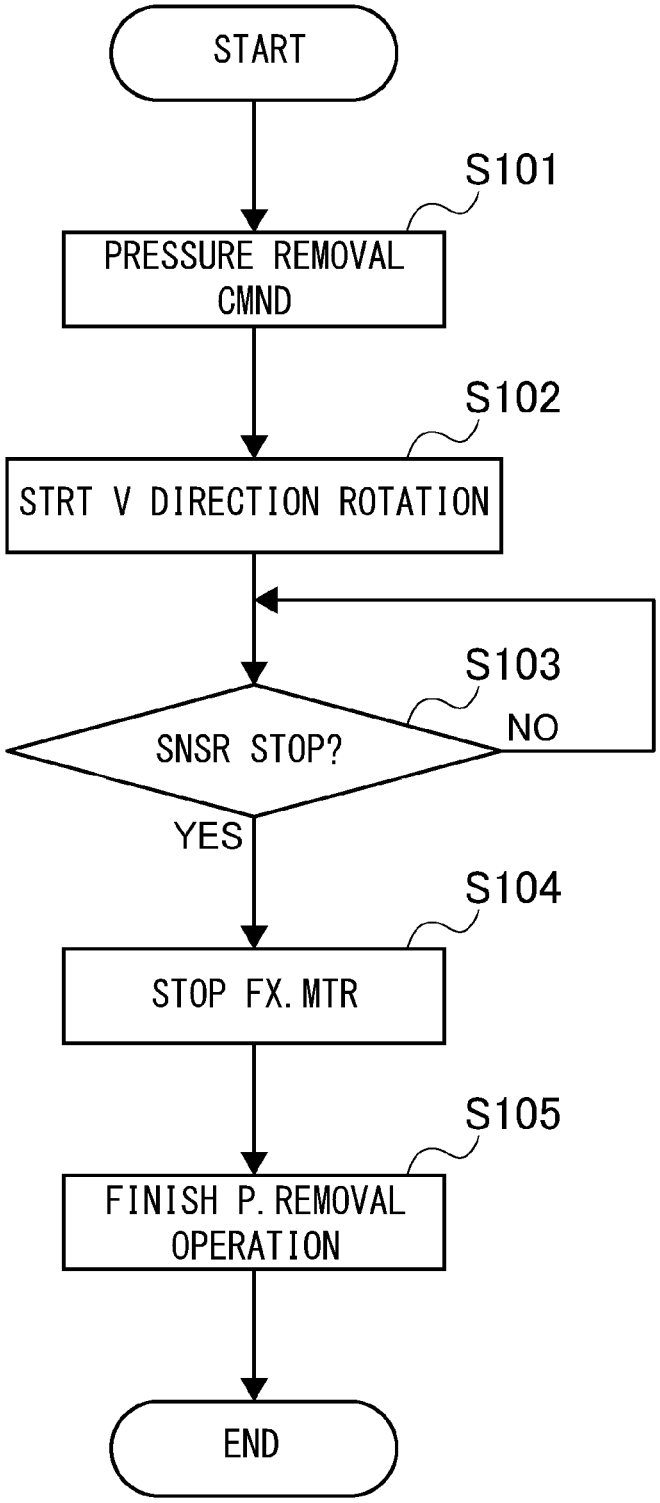
FIG. 7 is a flowchart of a control sequence, in the first embodiment, for causing the fixing device to carry out a pressure applying operation, or causing the fixing device to carry out a pressure removing operation.
Figure 8:
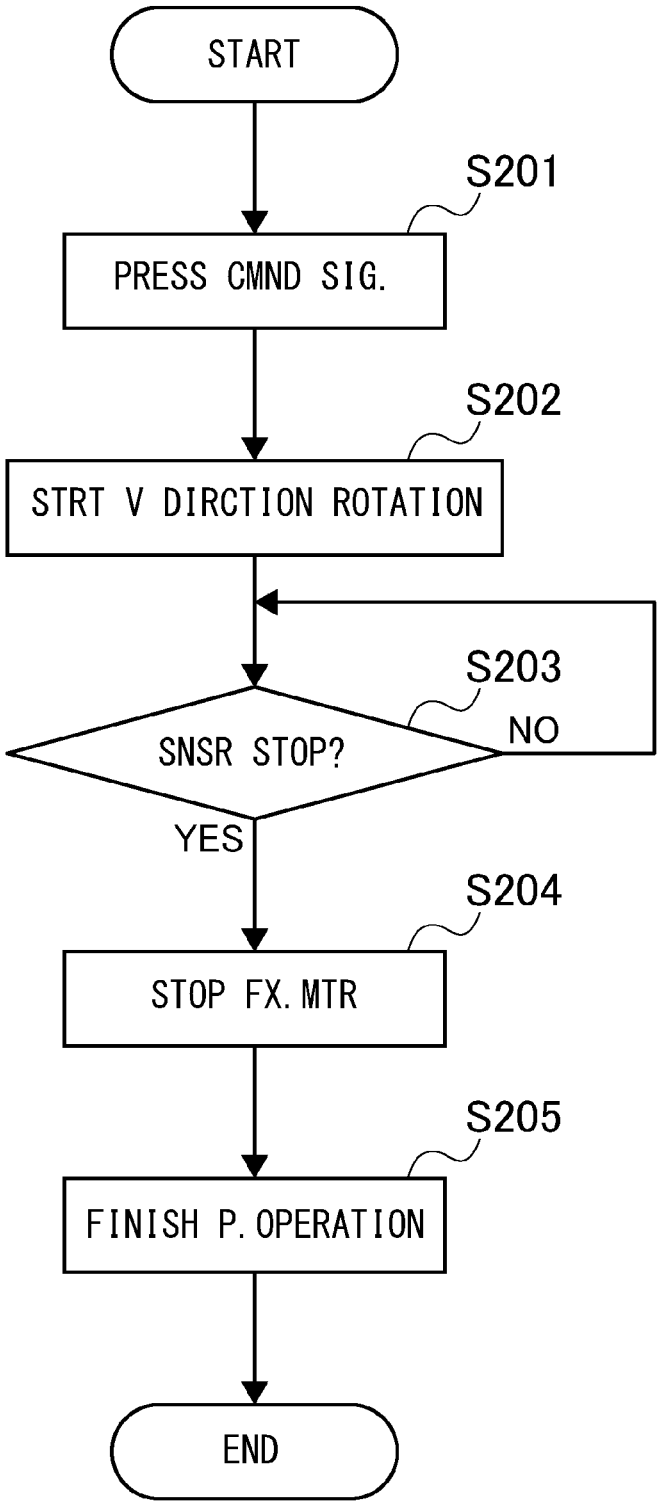
FIG. 8 is a flowchart of the pressure applying operation of the fixing device in the first embodiment.

Next, referring to FIGS. 4 and 5, along with FIGS. 6-8, the control of the pressure application operation and pressure removal operation of the fixing device 40 are described. Referring to FIG. 6, the control portion 800 is provided with a CPU 810, which controls the fixation motor 93 based on the signals from the contact/separation sensor 122*b*. By the way, the control portion 800 has a ROM 811 (Read Only Memory) and a RAM 812 (Random Access Memory), in addition to the CPU 810 (Central Processing Unit). The control portion 800 controls various portions of the image forming apparatus 600 while reading the programs in the ROM 811, which correspond to various control procedures. Further, in the RAM 812, operation data and input data are stored. The CPU 810 controls various portions of the image forming apparatus 600 based on the above described programs, etc., referring to data stored in the RAM 812. The control portion 800 structured as described above controls not only the pressure application operation and pressure removal operation of the fixing device 40, but also, the entirety of the image forming apparatus 600.

First, referring to FIG. 7, the pressure removal operation is described. The operation to change the fixing device 40 in the state of operation from the one in which the fixation belt 100 remains pressed upon the pressure roller 101 to the one in which the fixation belt 100 is not pressed upon the pressure roller 101 is started in response to a pressure removal command signal (S101), as shown in FIG. 7. A pressure removal command signal is outputted as a sensor for detecting a sheet P of recording medium while the sheet P is conveyed through the image forming apparatus 600 detects a jam; the door 80 is opened; the image forming apparatus 600 is put in the low power consumption mode; and the like.

Next, the CPU 810 stops the driving of the fixation motor 93. Then, it begins to rotate the fixation motor 93 in the direction indicated by the arrow mark V (FIG. 2) (S102). Thus, the driving force is transmitted through the driving force transmission path of the fixing device driving portion 90, causing the cam 120 to begin to rotate in the direction indicated by an arrow mark W, shown in FIG. 4. Thus, the flag 122*a* which is an integral part of the cam gear 121 and is coaxial with the cam shaft 123, also begins to rotate. Before the flag 122*a* begins to rotate, the beam of infrared light in the contact/separation sensor 122*b* remains unblocked, and remains unblocked until the flag 122*a* rotates by a preset angle after it begins to rotate, as shown in FIG. 4 (No in S103).

As the cam 120 rotates to the position shown in FIG. 5, the flag 122*a* blocks the path of the beam of infrared light in the contact/separation sensor 122*b*; the contact/separation sensor 122*b* is put in a state in which the beam of infrared light remains blocked (Yes in S103). Thus, the CPU 810 determines, based on the change in the state of the output signal of the contact/separation sensor 122*b*, that the fixation belt 100 is not being pressed upon the pressure roller 101. Then, it stops the driving of the fixation motor 93 (S104). This concludes the pressure removal operation (S105).

Next, referring to FIG. 8, the pressure applying operation is described. The pressure applying operation which starts when the fixing device 40 is in the state of no pressure, is started in response to a pressure application command signal, as shown in FIG. 8 (S201). The pressure application command signal is started by the inputting of an image formation job, pressing of an image formation start button, or the like. As a pressure application command signal is outputted, the CPU 810 starts the pressure applying operation for pressing the fixation belt 100 upon the pressure roller 101, to put the fixing device 40 back into the state in which the fixing device 40 is ready for image formation.

First, the CPU 810 makes the fixation motor 93 rotate in the direction indicated by the arrow mark Y (S202). Thus, the cam 120 is made to begin to rotate in the direction indicated by the arrow mark W in FIG. 5, by the transmission of the driving force through the driving force path of the fixing device driving portion 90. Thus, the flag 122*a*, which is an integral part of the cam gear 121 also begins to rotate. Referring to FIG. 5, until the flag 122*a* begins to rotate, the contact/separation sensor 122*b* is in the state in which it is blocking the beam of infrared. Until the flag 122*a* rotates by a preset angle after it begins to rotate, the contact/separation sensor 122*b* remains in the state in which the flag 122*a* continuously blocks the beam of infrared light (NO in S203).

Then, as the cam 120 rotates into the position shown in FIG. 4, the flag 122*a* moves out of the infrared light passage of the contact/separation sensor 122*b*, putting the contact/separation sensor 122*b* in the state in which the beam of infrared light traverses through light passage (YES in S203). Thus, the CPU 810 determines that the fixing device 40 is in the state of pressure application, because of the change in the state of the output signal of the contact/separation sensor 122*b*, and stops driving the fixation motor 93 (S204). This concludes the pressure applying operation (S205).

[Structure of Cam and Cam Shaft]

Next, referring to FIGS. 9 and 10, the structure of the cam 120 and cam shaft 123 are described. The cam shaft 123 is not circular in cross section. In this embodiment, it is in the form of a long and narrow trough, which is roughly U-shaped in cross section. It is formed by perpendicularly bending a rectangular piece of metallic plate along a pair of lines which are parallel to the long edges of the metallic plate. That is, referring to FIG. 10, which is a cross section of the combination of the cam 120 and cam shaft 123, the cam shaft 123 has a bottom portion (flat) 123*b* (comparatively to trough), and a pair of side wall portions 123*c* (which are perpendicular to the bottom portion 123*b*. In this embodiment, a piece of steel plate, which is electrically plated with zinc, and is 0.8 mm in thickness, was used as the material for the cam shaft 123. Usage of a piece of thin metallic plate as the material for the cam shaft 123 makes the cam shaft 123 lower in cost than a piece of round steel rod.

The cam shaft 123 is fitted with a pair of cams 120, and the cam gear 121. The cam gear 121 is attached to one of the lengthwise ends of the cam shaft 123. One of the cams 120 is solidly fitted around one of the lengthwise ends of the cam shaft 123, and the other is solidly fitted around a slightly inward portion, in terms of the lengthwise direction of the cam shaft 123, of the cam shaft 123 from the other lengthwise end. The cam gear 121 is provided with an elastically deformable engaging portion (unshown). The cam gear 121 can be fitted around the cam shaft 123. Referring to part (a) of FIG. 9, the cam shaft 123 is provided with a retention hole 123*a*, in which a projection, with which the latch portion (engaging portion) of the cam 120 is provided, fits. The retention hole 123*a* is a part of the bottom portion 123*b* of the cam shaft 123. The cam gear 121 is fixed to the cam shaft 123 in the following manner. Referring to part (b) of FIG. 9, first, the cam gear 121 is to be fitted around one of the lengthwise end portion of the cam shaft 123, Then, the cam gear 121 is to be slid toward the center of the cam shaft 123, with the latch portion of the cam 120 being kept elastically bent, until the projection fits into the retention hole 123*a*. Thus, the cam gear 121 is fixed to a preset portion of the cam shaft 123.

The cam 120 has a bearing portion 120*a*, a disk portion 120*b* as a pressure lever contacting portion, and a latch portion 120*c* as the second engaging portion, which are integral parts of the cam 120. Referring to FIG. 14, the bearing portion 120*a* is a portion of the cam 120, by which the cam 120 is rotatably supported by the fixation device frame 115. More specifically, the fixation device frame 115 is provided with a cylindrical hole 115*a*. As the cylindrical bearing portion 120*a* is inserted into the hole 115*a*, the bearing portion 120*a* is rotatably supported by the fixation device frame 115. Thus, the cam shaft 123 is rotatably supported by the fixation device frame 115, with the presence of the bearing portion 120*a* of the cam 120 between the cam shaft 123 and fixation device frame 115. Next, referring to FIG. 10, a referential code O stands for the rotational axis of the cam 120, which coincides with the rotational axis of the bearing portion 120*a*, and that of the cam shaft 123. By the way, in this embodiment, the bearing portion 120*a* as a supporting portion, disk portion 120*b* as a contacting portion, and latch portion 120*c* as the second engaging portion are molded as integral parts of the cam 120. However, the cam 120 may be structured so that the bearing portion 120*a* and latch portion 120*c* are molded together, whereas the disk portion 120*b* is separately molded from the bearing portion 120*a* and latch portion 120*c*.

In terms of the direction parallel to the axial line of the cam shaft 123, the disk portion 120*b* is on the outward side of the bearing portion 120*a*, and comes into contact with the pressure lever 112. Referring to FIG. 10, the disk portion 120*b* has multiple portions, which are different in the distance (which hereafter may be referred to as "radius") between their peripheral surface, which comes into contact with the pressure lever 112, and the rotational axis O of the cam 120.

On the other hand, the latch portion 120*c* is on the other side of the bearing portion 120*a* from the disk portion 120*b* in terms of the direction parallel to the axial line of the cam shaft 123. That is, in terms of the direction parallel to the rotational axis of the cam shaft 123, the latch portion 120*c* is on the opposite side of the bearing portion 120*a* from the disk portion 120*b*. The projection 120*d* of the latch portion 120*c*, which is positioned as described above, fits into the retention hole 123*a* (part (a) of FIGS. 9 and 9(*b*)) as the first engaging portion, with which the peripheral surface of the cam shaft 123 is provided, by elastically deforming.

That is, referring to FIG. 14 which will be explained later, the latch portion 120*c* is a snap-fitting portion having the projection 120*d* and a springy portion 120*e*. The projection 120*d* is shaped so that it can fit into the retention hole 123*a* of the cam shaft 123. The springy portion 120*e* is protrusive from the bearing portion 120*a* toward the opposite end portion of the cam shaft 123 from the disk portion 120*b*, in the direction parallel to the rotational axis of the cam shaft 123. It pressures the projection 120*d* toward the retention hole 123*a* by elastically deforming. More concretely, the springy portion 120*e* is in the form of a piece of plate, and remains in contact with the peripheral surface of the cam shaft 123 unless it is subjected to external force. The springy portion 120*e* generates such force that causes the projection 120*d* which is protrusive from the inward end of the springy portion 120*e* to enter the retention hole 123*a*, and keep the projection 120*d* in the retention hole 123*a*. By the way, the retention hole 123*a* as the first engaging portion also is in the bottom portion 123*b* of the cam shaft 123.

The cam 120, which is structured as described above, is fixed to the cam shaft 123 like the cam gear 121. That is, the cam 120 is fixed to the cam shaft 123 in the following manner. First, referring to part (b) of FIG. 9, the cam 120 is fitted around the cam shaft 123. Then, it is slid toward the center of the cam shaft 123, along the cam shaft 123, while keeping the latch portion 120*c* elastically deformed, until the projection 120*d* of the latch portion 120*c* fits into the retention hole 123*a*. Through this procedure, the cam 120 is fixed to the preset position of the cam shaft 123.

[Cam (Disk) Surface]

Next, referring to FIG. 10, a peripheral surface 120*f* of the disk portion 120*b* of the cam 120 is described in greater detail. As described above, the cam 120 is provided with the disk portion 120*b*, which comes into contact with the pressure lever 112. The disk portion 120*b* has such a profile that it is not uniform in the distance between the peripheral surface 120*f*, which is the peripheral surface of the disk portion 120*b*, and the rotational axis of the cam 120 (disk portion 120*b*). Therefore, it is possible to change the state of the fixing device 40 between the one in which pressure is applied, and the one in which no pressure is applied, by rotating the cam 120 to change the fixing device 40 in the amount by which the pressure lever 112 pivotally moves.

In this embodiment, the fixing device 40 is structured so that when the center 120*g* of the portion of the peripheral surface 120*f* of the portion of the disk portion 120*b*, which is largest in radius, is in contact with the pressure lever 112, the fixation nip N is free of pressure. The portion of the disk portion 120*b*, which is largest in radius, is such a portion of the disk portion 120*b* that lifts the pressure lever 112 highest. That is, this portion of the disk portion 120*b* is the largest in the amount of load which the disk portion 120*b* receives from the pressure lever 112. Therefore, this portion of the disk portion 120*b* is referred to as "maximum load portion". The disk portion 120*b* is designed so that this portion of the disk portion 120*b* is large enough to assure that the pressure is removed regardless of the fluctuation in the rotational movement of the cam 120 in terms of rotational phase. By the way, the maximum load portion is the portion of the disk portion 120*b*, which is the largest in the distance between its peripheral surface 120*f* and the rotational axis of the cam 120 (disk portion 120*b*).

On the other hand, from the standpoint of minimizing the fixing device 40 in the amount of the load to which the disk portion 120*b* is subjected when the fixing device 40 is switched in the state of operation from the one in which the pressure roller 101 is free from pressure, and the one in which the pressure roller 101 is under the pressure, it is desired that the disk portion 120*b* is as gentle as possible in the change in the radius from the portion which corresponds to the state of pressure application to the portion which corresponds to the state of no pressure application. That is, it is desired that the disk portion 120*b* is designed so that the portion of the disk portion 120*b*, which is nonuniform in radius, is as large as possible, and accordingly, the maximum load portion of the disk portion 120*b* is as small as possible. In this embodiment, the angle of the maximum load portion of the disk portion 120*b* is set to roughly 60°.

[Relationship Between Maximum Load Portion and Point of Engagement]

Next, the relationship between the maximum load portion of the disk portion 120*b*, and the position of the cam 120 relative to the cam shaft 123 is described. To begin with, in this embodiment, in terms of the rotational direction of the cam 120, the projection 120*d* of the latch portion 120*c* as the second engaging portion fits into the retention hole 123*a*, which is no less than 90° apart from the maximum load position, which is the largest in the amount of the load from the pressure lever 112, for the following reason. That is, for example, if there is only one point of the peripheral surface of the cam 120 that is largest in terms of the radius of the cam 120 (distance from rotational axis O of cam 120), this point is the maximum load point. This means that the projection 120*d* of the latch portion 120*c* fits into the retention hole 123*a*, at this point which is no less than 90° apart from the maximum load point.

On the other hand, there are cases where the cam 120 has more than one point which is the largest in radius. For example, there is a case where a preset range of the peripheral surface of the cam 120 has the largest radius, as in this embodiment. In such a case, that is, a case where a preset range of the peripheral surface of the cam 120 is the largest in the amount of the load it receives from the pressure lever 112, the fixing device 40 is structured so that the relationship between the maximum load range, and the point of engagement satisfies the following condition. That is, the fixing device 40 is structured so that the retention hole 123*a*, into which the projection 120*d* of the latch portion 120*c* fits, is positioned in the area in which an area which extends no less than 90° in the rotational direction of the cam 120, from the upstream end of the maximum load area, and an area which extends no less than 90° in the opposite direction from the rotational direction of the cam 120 from the downstream end of the maximum load area.

That is, referring to FIG. 10, L1 and L2 stand for the upstream and downstream ends of the maximum load area of the cam 120 in terms of the rotational direction of the cam 120. Further, M1 and N1 stand for the points which are 90° apart in the upstream and downstream directions, respectively, from L1, in terms of the rotational direction of the cam 120. M2 and N2 stand for the points which are 90° apart in the upstream and downstream directions, respectively, from L2, in terms of the rotational direction of the cam 120. Therefore, the area across which the areas which extend no less than 90° from the points L1 and L2 overlap with each other, is the area between the point M1 to the point N1 (range indicated by arrow mark). In other words, the fixing device 40 is structured so that the projection 120*d* of the latch portion 120*c* fits in the retention hole 123*a* in this area. Thus, the point at which the projection 120*d* of the latch portion 120*c* fits into the retention hole 123*a* will be in the area which are no less than 90° apart from any point in the maximum load area.

In this embodiment, the latch portion 120*c* is roughly 180° apart from the center 120*g* of the maximum load area of the peripheral surface 120*f* of the cam 120 in terms of the rotational direction of the cam 120. In other words, the latch portion 120*c* is on the opposite side of the rotational axis O from the center 120*g*.

Next, referring to FIGS. 11-14, the reason why the fixing device 40 is structured so that the relationship between the maximum load area and engaging portion satisfies the above described one is described. FIG. 11 is a perspective view of the fixing device 40 when the fixing device 40 is in the state of pressure application. FIG. 12 is a perspective view of the fixing device 40 when the fixing device 40 is in the state of no pressure application. By the way, FIGS. 11 and 12 are slightly different from FIG. 2 in the structure of the fixing device driving portion 90. However, the two fixing device driving portions 90 are the same in function. Further, FIG. 13 is a sectional view of the combination of the cam 120 and the corresponding lengthwise end portions of the cam shaft 123, of a comparative fixing device. It shows the relationship between the cam 120 and cam shaft 123. FIG. 14 is a sectional view of the combination of the cam 120 and the corresponding lengthwise end portions of the cam shaft 123, of the fixing device in this embodiment. It shows the relationship between the cam 120 and cam shaft 123. The comparative fixing device 40 is the same in overall structure as the fixing device 40 in this embodiment, except for the comparative cam 120A.

Referring to FIGS. 13 and 14, in both the comparative fixing device 40 and the fixing device 40 in this embodiment, the cam 120, the disk portion 120*b*, bearing portion 120*a*, and latch portion 120*c* are positioned in the listed order in terms of the direction parallel to the axial line of the cam shaft 123. That is, the latch portion 120*c* and disk portion 120*b* is on the opposite side of the bearing portion 120*a* from each other. That is, the latch portion 120*c* is on the inward side of the fixation device frame 115, and the disk portion 120*b* is on the outward side of the fixation device frame 115.

Referring to FIG. 13, in the case of the comparative cam 120A, the latch portion 120*c* is roughly at the same point as the center 120*g* (FIG. 10) of the area (maximum load area) which is the largest in radius, in terms of the cam rotation about the rotational axis of the cam 120. That is, the difference in rotational phase between the point of the maximum load, and the point of engagement between the latch portion 120*c* and retention hole 123*a* is no more than 90°. In the case of the comparative fixing device 40, the point of maximum load and the point of engagement between the latch portion 120*c* and retention hole 123*a* are roughly the same in rotational phase.

By the way, as the fixing device 40 changes in the state of operation from the state of pressure application shown in FIG. 11, to the state of no pressure application, shown in FIG. 12, into which it is placed by the pressure removal operation, the disk portions 120*b* which are at the lengthwise end portion of the cam shaft 123, one for one, are pressed by the pressure lever 112; they are pressed in the direction indicated by an arrow mark A. That is, when the fixing device 40 is in the state of no pressure application, the center 120*g* of the maximum load area is in contact with the pressure lever 112, the pressure lever 112 is kept in its highest position in the range of its pivotal movement, by the cam 120. Therefore, the disk portion 120*b* remains subjected to the largest amount of load by the pressure lever 112.

Referring to FIG. 13, in the case of the comparative fixing device 40, as the disk portion 120*b* is subjected to the load which works in the direction indicated by the arrow mark A, the latch portion 120*c* tends to deform in the direction indicated by an arrow mark B in such a manner that it pivotally deforms about the bearing portion 120*a*. However, there is nothing to prevent the deformation of the latch portion 120*c* in the direction indicated by the arrow mark B. Therefore, the latch portion 120*c* deforms in such a direction that causes its projection 120*d* to come out of the retention hole 123*a* of the cam shaft 123. Further, the load to which the disk portion 120*b* is subjected increases. If the amount of deformation of the latch portion 120*c* exceeds the amount of engagement between the projection 120*d* and retention hole 123*a*, it is possible that the cam 120 will disengage from the cam shaft 123.

On the other hand, in the case of the fixing device 40 in this embodiment, as the disk portion 120*b* is subjected to the load directed as indicated by the arrow mark A, as shown in FIG. 14, the latch portion 120*c* tends to deform in the direction indicated by an arrow mark C in such a manner that it pivotally deforms about the bearing portion 120*a*. This direction of deformation is parallel to the direction of contact between the latch portion 120*c* and cam shaft 123. Therefore, the latch portion 120*c* deforms in such a manner that its projection 120*d* is pushed into the retention hole 123*a*, with which the cam shaft 123 is provided. Further, even if the load with which the disk portion 120*b* is subjected becomes substantial, the amount by which the latch portion 120*c* is allowed to deform is regulated by the cam shaft 123. That is, the latch portion 120*c* is pressed in the direction to cause the projection 120*d* to be pushed into the retention hole 123*a*. Therefore, it is possible to prevent the problem that the cam 120 disengages from the cam shaft 123. That is, in the case of the fixing device 40 in this embodiment, even if it is structured so that the cam 120 is provided with the latch portion 120*c* having the projection 120*d* which fits into the retention hole 123*a* of the cam shaft 123 as the latch portion 120*c* is elastically deformed, the projection 120*d* of the latch portion 120*c* is unlikely to come out of the retention hole 123*a*.

By the way, in this embodiment, the latch portion 120*c* is positioned roughly 180° away in terms of the rotational direction of the cam 120 from the center 120*g* of the portion (largest load area) of the peripheral surface 120*f* which is largest in distance (radium) from the rotational axis O of the cam 120, in order to ensure that as the peripheral surface 120*f* of the cam 120 contacts the pressure lever 112 by its center 120*g*, the fixing device 40 is put into the pressure free state. However, all that is necessary is that the latch portion 120*c* is within the area (area between points M1 and N1) where the two portions of the cam 120, which extend no less than 90° in the rotational direction of the cam 120 from the ends L1 and L2 (FIG. 10) of the maximum load area in terms of the rotational direction of the cam 120, overlap with each other.

For example, in a case where the latch portion 120*c* is in a position which is 90° away from the maximum load area, even if the disk portion 120*b* is subjected to such a load that is directed as indicated by the arrow mark A, this load does not cause the latch portion 120*c* to deform in the direction to cause the projection 120*d* of the latch portion 120*c* to come out of the retention hole 123*a*. In this case, the load does not function to push the projection 120*d* of the latch portion 120*c* into the retention hole 123*a*. However, it also does not function to cause the projection 120*d* of the latch portion 120*c* to come out of the retention hole 123*a*. Therefore, the projection 120*d* of the latch portion 120*c* is unlikely to come out of the retention hole 123*a*.

Further, in a case where the latch portion 120*c* is in a position which is no less than 90° away from the maximum load position, as the disk portion 120*b* is subjected to a load which is directed as indicated by the arrow mark A, this load functions in such a manner that it presses the projection 120*d* of the latch portion 120*c* into the retention hole 123*a*. In this case, the amount of the load is affected by the distance (in terms of angle) between the end of the maximum load area and the latch portion 120*c*. However, regardless of the position (in terms of rotational phase) of the latch portion 120*c*, the load functions in the direction to press the projection 120*d* of the latch portion 120*c* into the retention hole 123*a*. Therefore, the projection 120*d* of the latch portion 120*c* is unlikely to come out of the retention hole 123*a*.

Embodiment 2

Next, referring to FIG. 15, along with FIG. 4, the second embodiment of the present invention is described. In the first embodiment, the fixing device 40 was structured so that a preset range of the peripheral surface 120*f* of the disk portion 120*b* of the cam 120 functions as the maximum load area. In comparison, in this embodiment, the fixing device 40 is structured so that a peripheral surface 120*f*1 is provided with two maximum load areas. Otherwise, the components, portions thereof, etc., of the fixing device 40 in this embodiment are the same in structure and function as the counterparts of the fixing device 40 in the first embodiment. Therefore, if a given component, portions thereof, etc., of the fixing device 40 in this embodiment is the same in structure as the counterpart in the first embodiment, it is given the same referential code as the counterpart, and is going to be simplified in illustration and/or description, or may not be described or illustrated at all. Hereafter, the description of the second embodiment of the present invention is concentrated upon the difference of this embodiment from the first one.

Referring to FIG. 15, in this embodiment, the disk portion 120*b* of a cam 120B has two maximum load areas. Further, the disk portion 120*b* has two maximum load points P1 and P2, and a flat area 120*h* which is between the maximum load points P1 and P2 in terms of the rotational direction of the cam 120B. As the cam shaft 123 is rotated into a preset angular position, the cam 120B in this embodiment, which is structured as described above, comes into contact with the pressure lever 112 (FIGS. 4 and 5), by its flat area 120*h*. This preset position is where the cam 120B puts the fixing device 40 in the pressure free state by pushing up the pressure lever 112. In this embodiment, therefore, the position in which the cam 120B removes pressure from the pressure roller 101 is not the maximum load position.

The fixing device 40 in this embodiment is structured so that it is put in the pressure free state as the flat area 120*h* of the peripheral surface 120*f*1 comes into contact with the pressure lever 112 as described above. Therefore, the fixing device 40 remains stable in state when it is in the pressure free state. Further, the two edges P1 and P2 of the flat area 120*h* were made maximum load points, making it unlikely for the cam 120B to unexpectedly rotate out of the pressure free position. That is, in order for the cam 120B to rotate out of the pressure free position, the maximum load point P1 or P2 of the cam 120B has to move past the point of contact between the cam 120B and pressure lever 112. That is, the point P1 or P2 of the cam 120B, which is the largest in the amount of the load which it receives from the pressure lever 112 has to move past the pressure lever 112. Therefore, even if an external force happens to act on the cam 120B in the direction to rotate the cam 120B, the cam 120B is unlikely to unexpectedly rotate in manner to cause the fixing device 40 to be out of the pressure free state.

In this embodiment, the disk portion 120*b* of the cam 120B is given such a profile that it gradually increases in radius from a point at which it is smallest in radium, toward the maximum load point P1 or P2, and then, the area 120*h* between the points P1 and P2 is made flat. However, the peripheral surface of the disk portion 120*b* of the cam 120B does not need to be provided with a flat area such as the one described above. Instead, the upstream and downstream edges of the area of the peripheral surface 120*f*1 of the disk portion 120*b* of the cam 120B, which puts the fixing device 40 in the pressure free state, may be provided with a protrusion which functions as the maximum load point.

In this embodiment, the fixing device 40 is structured so that in terms of the rotational direction of the cam 120B, the projection 120*d* of the latch portion 120*c* fits into the retention hole 123*a* of the cam shaft 123, in the area in which two area of the disk portion 120*b* of the cam 120B, which extend no less than 90° in the opposite direction from the maximum load point P1 and P2, respectively, overlap with each other.

That is, referring to FIGS. 15, Q1 and R1 stand for the points which are 90° away, in terms of the rotational direction of the cam 120B, from the maximum load point P1. Similarly, Q2 and R2 stand for are points which are 90° away, in terms of the rotational direction of the cam 120B, from the maximum load point P2. Thus, the area in which two areas which extend no less than 90° in the opposite direction from the maximum load point P1 and P2, respectively, overlap with each other is the area (indicated by arrow mark) between the points Q1 and R2. The fixing device 40 is structured so that the projection 120*d* of the latch portion 120*c* fits into the retention hole 123*a* in this area. With the fixing device 40 being structured as described above, the point at which the projection 120*d* fits into the retention hole 123*a* is no less than 90° away from the maximum load area.

Also in the case of the fixing device 40 in this embodiment described above, even though the fixing device 40 is structured so that the cam 120B is provided with the latch portion 120*c* having the projection 120*d* which is made to fit into the retention hole 123*a* of the cam shaft 123, by the deformation of the latch portion 120*c*, like the one in the first embodiment. Therefore, the projection 120*d* of the latch portion 120*c* is unlikely to come out of the retention hole 123*a*. Also, in this embodiment, when the cam 120B is in the pressure removal position, the disk portion 120*b* is not subjected to the maximum load, but, it is subjected to the maximum load at the maximum load point P1 (or P2 while the cam 120B rotates between the pressure application area and pressure removal area.

Therefore, if the fixing device 40 is designed so that the projection 120*d* of the latch portion 120*c* of the cam 120B fits in the retention hole 123*a* of the cam shaft 123 as shown in FIG. 13, the projection 120*d* of the latch portion 120*c* will possibly come out of the retention hole 123*a*, when the maximum load point P1 (or P2) of the peripheral surface of the disk portion 120*b* moves past the point of contact between the disk portion 120*b* and pressure lever 112. In this embodiment, however, the fixing device 40 is structured so that the angular distance is provided between the maximum load points P1 and P2, and the point of engagement between the projection 120*d* of the latch portion 120*c*, instead of the pressure removal point. Therefore, it is unlikely to occur that the projection 120*d* of the latch portion 120*c* comes out of the retention hole 123*a* of the cam shaft 123 while the cam 120B rotates.

By the way, in the description of the second embodiment given above, the disk portion 120*b* was provided with two maximum load points. However, the effects of this embodiment are the same, even if the disk portion 120*b* is provided with no less than three maximum load points. That is, in such a case, the fixing device 40 has only to be structured so that the projection 120*d* of the latch portion 120*c* fits in the retention hole 123*a*, within the area in which the portions of the disk portion 120*b*, which extend no less than 90° in the rotational direction of the cam 120 from three or more maximum load points overlap among them.

Embodiment 3

Next, referring to FIGS. 16 and 17 along with FIG. 10, the third embodiment of the present invention is described. In the first and second embodiments described above, the fixing device 40 was structured so that the disk portion 120*b* of the cam 120 was on the opposite side of the bearing portion 120*a* from the latch portion 120*c*. In comparison, in this embodiment, the fixing device 40 is structured so that the disk portion 120*b* and latch portion 120*c* of the cam 120 are on the same side of the bearing portion 120*a*. Otherwise, the components, portions thereof, etc., of the fixing device 40 in this embodiment are the same in structure and function as the counterparts of the fixing device 40 in the first embodiment. Thus, the components, portions thereof, etc., of the fixing device 40 in this embodiment, which are the same in structure as the counterparts in the first embodiment are given the same referential codes, one for one, and are not described and/or illustrated, or are only briefly described. The description of this embodiment is centered around the difference between the difference of this embodiment from the first one.

Referring to part (a) of FIG. 16, also in this embodiment, the cam shaft 123 is provided with a cam retention hole 123*a* as the first engagement portion, in which the projection 120*d* (FIG. 17) of the projection 120*d* of the latch portion 120*c* of a cam 120D fits. The cam 120D is fixed to the cam shaft 123 in the following manner; first, the cam 120D is fitted around the cam shaft 123 from one of the lengthwise ends of the cam shaft 123, as shown in part (b) of FIG. 16, and then, is slid toward the center of the cam shaft 123 along the cam shaft 123, with the latch portion 120*c* kept elastically deformed, until the projection 120*d* fits into the retention hole 123*a* of the cam shaft 123.

Also in this embodiment, the cam 120D is provided with the bearing portion 120*a* as a supporting portion, a disk portion 120*b* as a contacting portion, and a latch portion 120*c* as the second engaging portion, which are formed as integral parts of the cam 120D, like the cam 120 in the first embodiment. However, the cam 120D in this embodiment is slightly different from the one in the first embodiment.

Referring to FIG. 17, in this embodiment, the disk portion 120*b* is positioned next to the bearing portion 120*a* in terms of the direction parallel to the rotational axis of the cam shaft 123, and the latch portion 120*c* is positioned next to the disk portion 120*b*. That is, in terms of the direction of the cam shaft 123, the latch portion 120*c* is positioned on the same side of the bearing portion 120*a* as the disk portion 120*b*. Further, the fixing device 40 is structured so that the latch portion 120*c* extends further from the other side of the disk portion 120*b* in the direction of the axial line of the cam shaft 123. In other words, the disk portion 120*b* is positioned on the outward side of the fixation device frame 115, and the latch portion 120*c* is on the further outward side of the disk portion 120*b*.

Next, the positional relationship between the maximum load area(s) of the peripheral surface 120*f* of the disk portion 120*b*, and the portion of the cam shaft 123, to which the cam 120D is attached, is described. First, in this embodiment, in terms of the rotational direction of the cam 120D, the projection 120*d* of the latch portion 120*c* as the second engaging portion, fits in the retention hole 123*a*, at a position which is no less than 90° apart from the maximum load point where the load which the cam 120D receives from the pressure lever 112 is maximum.

Further, also in this embodiment, the cam 120D is given the profile shown in FIG. 10. Therefore, the peripheral surface 120*f* has the maximum load area. Therefore, the projection 120*d* of the latch portion 120*c* fits into the retention hole 123*a*, within an area in which the areas of the disk portion 120*b* which extend no less than 90° in the rotational direction of the cam 120D from the edge of the maximum load area, overlap with each other. That is, referring to FIG. 10, the fixing device 40 is structured so that the projection 120*d* of the latch portion 120*c* fits into the retention hole 123*a*, within the range which is on the maximum load area side of the rotational axis O of the cam shaft 123, and within the range between the points M2 and N1.

In this embodiment, the latch portion 120*c* is positioned in a position which is roughly the same in rotational phase as the center 120*g* of the maximum load area of the peripheral surface 120*f* of the disk portion 120*b* of the cam 120, relative to the rotational axis O of the cam 120.

As described above, in terms of the direction of the axial line of the cam shaft 123, in the case of the cam 120D in this embodiment, the latch portion 120*c*, disk portion 120*b*, and bearing portion 120*a* are positioned in the listed order. That is, the latch portion 120*c* and disk portion 120*b* are on the same side of the bearing portion 120*a*, and the latch portion 120*c* is on the opposite side of the disk portion 120*b* from the bearing portion 120*a*.

Referring to FIG. 17, as the disk portion 120*b* is subjected to a load which acts in the direction indicated by the arrow mark A, the latch portion 120*c* tends to deform in the direction indicated by the arrow mark D. The direction of this deformation is the same as the direction in which the latch portion 120*c* contacts the cam shaft 123. Therefore, the latch portion 120*c* deforms in such a direction that the projection 120*d* is pushed into the retention hole 123*a* of the cam shaft 123. Further, even if the load borne by the disk portion 120*b* increases, the amount by which the latch portion 120*c* deforms is regulated by the cam shaft 123, and the latch portion 120*c* is pressed in such a direction that the projection 120*d* of the latch portion 120*c* is pressed into the retention hole 123*a*. Therefore, it is possible to prevent the cam 120 from disengaging from the cam shaft 123. That is, in this embodiment, even through the fixing device 40 is structured so that the cam 120 is provided with the latch portion 120*c* which causes its projection 120*d* to fit into the retention hole 123*a* of the cam shaft 123 by being deformed. Therefore, the projection 120*d* of the latch portion 120*c* is unlikely to come out of the retention hole 123*a*.

By the way, in this embodiment, the latch portion 120*c* is positioned at roughly the same point as the center 120*g* of the area (maximum load area) where disk portion 120*b* is largest in radius, as the rotational axis O of the cam 120, because the fixing device 40 is put in the pressure free state by causing the disk portion 120*b* to contact the pressure lever 112 by the center 120*g* of the maximum load area of the peripheral surface 120*f*. However, the fixing device 40 has only to be structured so that the latch portion 120*c* is in the area (between points M2 and N1) where the areas which extend no more than 90° from the edges L1 and L2 (FIG. 10) of the maximum load area in terms of the rotational direction of the cam 120, overlap with each other as described above. As far as this point is concerned, this embodiment is similar to the first embodiment, except whether the angular distance between the maximum load area and cam shaft engaging point is no less than 90° or no more than 90°.

Further, this embodiment may employ the cam profile in the second embodiment. That is, in a case where the cam 120 is provided with two or more maximum load points (areas), the fixing device 40 is to be structured so that the projection 120*d* of the latch portion 120*c* fits into the retention hole 123*a*, within the area where the areas which extend no less than 90° from the edges of the maximum load areas, in the rotational direction of the cam shaft 123, overlap with each other.

In particular, in a case where the cam profile is such that the peripheral surface 120*fl* has the flat portion 120*h*, and two maximum load points P1 and P2, the fixing device 40 is to be structured as follows: in terms of the rotational direction of the cam 120, the fixing device 40 is to be structured so that the projection 120*d* of the latch portion 120*c* fits into the retention hole 123*a*, within the area where the portions of the disk portion 120*b*, which extend no more than 90° from the maximum load points P1 and P2, overlap with each other. More concretely, referring to FIG. 15, the fixing device 40 is to be structured so that the projection 120*d* of the latch portion 120*c* fits into the retention hole 123*a*, on the maximum load area side of the rotational axis, and within the area between point Q2 and point R1.

By the way, also in this embodiment, the fixing device 40 may be structured so that the disk portion 120*b* is provided with a pair of projections which protrude from the edges of a preset area, instead of the flat portion, in terms of the rotational direction of the cam 120, which puts the fixing device 40 in the pressure free state, as in the second embodiment, and the points of the peripheral surface of the disk portion 120*b*, which correspond to these projection, may be used as the maximum load points.

<Others>

In the foregoing embodiments, the cam shaft 123 was formed of a piece of metallic plate, and was in the form of a trough which is roughly U-shaped in cross section. However, the present invention is also compatible with cam shafts which are different from those in the preceding embodiment. For example, it is compatible with a cam shaft which is formed of a piece of metallic plate, and is in the form of a piece of hollow metallic rod, which is square in cross section, a piece of solid rod which is square in cross section, a piece of solid rod which is roughly D-shaped in cross section, etc.

Also in the preceding embodiments described above, the fixing device 40 was structured so that when the disk portion 120*b* is in contact with the pressure lever 112 by the center 120*g* of its area which is the largest in radius, the fixing device 40 is in the pressure free state. However, the present invention is also applicable to a fixing device structured so that the cam 120 pushes up the pressure lever 112 to put the fixing device in the state of pressure application. In the case of a fixing device structured in this manner, the state in which the disk portion 120*b* is in contact with the pressure lever 112 by the center 120*g* of its area of the disk portion 120*b*, which is the largest in radium, is the state of pressure application.

Further, in each of the preceding embodiments, the disk portion 120*b* of the cam 120 was given such a profile that it is symmetrical with reference to the line which coincides with the rotational axis O of the cam 120 and the pressure removal point (center 120*g* of pressure removal area). However, the disk portion 120*b* may be asymmetrical. In such a case, a fixing device may be structured so that only one side of the disk portion 120*b*, with reference to the aforementioned referential line, is provided with a maximum load point like the one in the second embodiment.

Further, in each of the preceding embodiments described above, a cam was employed as the rotational member. However, the present invention is also applicable to a fixing device, the rotational member of which is circular in cross section, that is, uniform in radius from its rotational axis. Even if a fixing device has such a structure, the present invention is applicable as long as the load to which the rotational member is subjected changes in amount according to the rotational phase of the rotational member.

Further, in each of the preceding embodiments described above, a fixation belt was employed by the heater side of the fixing device 40, and a pressure roller was employed as a member for forming a nip between the belt and itself. However, these embodiments are not intended to limit the present invention in scope in terms of the method for forming the nip. For example, the present invention is also applicable to a fixing device which employs an endless belt in place of the pressure roller, or a fixing device, the heater side of which employs an endless belt which is suspended and tensioned by rollers. Further, the present invention is also applicable to a fixing device which is conventionally structured. For example, the present invention is also applicable to a fixing device which uses a heating method based on an IH.

Further, in each of the embodiments described above, the fixing device was structured so that a fixation belt as the first rotational member and a pressure roller as the second rotational member are placed in contact with each other or separated from each other. However, the present invention is also applicable to an image forming device structured so that its intermediary transfer belt is placed in contact with, or separated from, its photosensitive drum. Further, it is applicable to a fixing device structured so that its external heating member for externally heating its fixing members such as a fixation belt and/or fixation roller, is placed in contact with, or separated from its fixing member. Further, the present invention is also applicable to a fixing device structured so that its cleaning member which cleans its fixing member with a piece of cleaning web or the like is placed in contact with, or separated from, its fixing member. Moreover, not only is the present invention applicable to a fixing device structured so that its first and second rotational members are placed in contact with, or separated from, each other, but also, a fixing device structured so that the contact pressure between its first and second rotational members changes with no separation of the first and second rotational members from each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-085385 filed on Apr. 26, 2019, which is hereby incorporated by reference herein in its entirety.

What is claimed is:

1. A pressing device for pressing an object, aid the pressing device comprising:

a pressing lever rotatable about a fulcrum and configured to press the object;

a rotatable shaft including a rotational axis and a portion-to-be-engaged;

a side plate supporting said rotatable shaft; and a cam fixed on said rotatable shaft, said cam including:

(i) a cam portion having an outer peripheral surface including portions away from the rotational axis of said rotatable shaft by different distances, said cam portion being contactable to said pressing lever to cause said pressing lever to apply a pressure to the object; and (ii) a snap fit portion having a free end and an engaging portion at the free end of said snap fit portion, said engaging portion engageable with said portion-to-be-engaged provided on said rotatable shaft to fix said cam to said rotatable shaft, wherein said cam portion is provided on one side of said side plate with respect to a direction of the rotational axis, and said snap fit portion is provided on the other side thereof, and wherein said portion-to-be-engaged has a phase not less than 90 degrees away from a portion of the outer peripheral surface of said cam portion where the distance between the rotational axis and the outer peripheral surface of said cam portion is maximum.

2. A device according to claim 1, wherein said portion-to-be-engaged is in the form of a hole provided in an outer peripheral surface of said rotatable shaft.

3. A device according to claim 1, wherein a plurality of such maximum distance portions are provided, and said engaging portion is in a rotational direction range in which zones having not less than 90 degrees phase difference from the maximum distance portions, respectively are overlapped with each other.

4. A device according to claim 1, wherein said cam portion and said snap fit portion are integrally formed with each other.

5. A device according to claim 1, wherein said cam further includes a bearing member supporting said cam portion, wherein said snap fit portion is integrally formed with said bearing member.

6. A device according to claim 1, further comprising a gear provided on said rotatable shaft and configured to rotate said rotatable shaft.

7. A device according to claim 1, comprising a plurality of said cams which are provided on opposite end portions of said rotatable shaft, respectively.

8. A device according to claim 1, wherein said rotatable shaft is provided with a flat surface portion, and said portion-to-be-engaged is provided on said flat surface portion.

9. A fixing device for fixing a toner image on a recording material carrying a toner image by heating and pressing the recording material, said fixing device comprising:

a first rotatable member;

a second rotatable member cooperative with said first rotatable member to form a nip for heating the toner image on the recording material; and a pressing device according to claim 1 configured to press said first rotatable member against said second rotatable member.

10. A pressing device for pressing an object, said pressing device including:

a pressing lever rotatable about a fulcrum and configured to press the object;

a rotatable shaft including a rotational axis and a portion-to-be-engaged;

a side plate supporting said rotatable shaft; and a cam fixed on said rotatable shaft, said cam including:

(i) a cam portion having an outer peripheral surface including portions away from the rotational axis of said rotatable shaft by different distances, said cam portion being contactable to said pressing lever to cause said pressing lever to apply a pressure to the object; and (ii) a snap fit portion having a free end and an engaging portion engageable with said portion-to-be-engaged provided on said rotatable shaft to fix said cam to said rotatable shaft, wherein said cam portion and said snap fit portion are provided on one side of said side plate in a direction of the rotational axis, and wherein said portion-to-be-engaged has a phase not less than 90 degrees away from a portion of the outer peripheral surface of said cam portion where the distance between the rotational axis and the outer peripheral surface of said cam portion is maximum.

11. A device according to claim 10, wherein said portion-to-be-engaged is in the form of a hole provided in an outer peripheral surface of said rotatable shaft.

12. A device according to claim 10, wherein a plurality of such maximum distance portions are provided, and said engaging portion is in a rotational direction range in which zones having not less than 90 degrees phase difference from the maximum distance portions, respectively are overlapped with each other.

13. A device according to claim 10, wherein said cam portion and said snap fit portion are integrally formed with each other.

14. A device according to claim 10, wherein said cam further includes a bearing member supporting said cam portion, wherein said snap fit portion is integrally formed with said bearing member.

15. A device according to claim 10, further comprising a gear provided on said rotation shaft and configured to rotate said rotatable shaft.

16. A device according to claim 10, comprising a plurality of said cams which are provided to opposite end portions of said rotatable shaft, respectively.

17. A device according to claim 10, wherein said rotatable shaft is provided with a flat surface portion, and said portion-to-be-engaged is provided on said flat surface portion.

18. A fixing device for fixing a toner image on a recording material carrying a toner image by heating and pressing the recording material, said fixing device comprising:

a first rotatable member;

a second rotatable member cooperative with said first rotatable member to form a nip for heating the toner image on the recording material; and a pressing device according to claim 10 configured to press said first rotatable member against said second rotatable member.

* * * * *